US008978788B2

(12) United States Patent
Vempati et al.

(10) Patent No.: US 8,978,788 B2
(45) Date of Patent: Mar. 17, 2015

(54) CUTTING ELEMENT FOR A DRILL BIT USED IN DRILLING SUBTERRANEAN FORMATIONS

(75) Inventors: Chaitanya K. Vempati, The Woodlands, TX (US); Suresh G. Patel, The Woodlands, TX (US); Jack Thomas Oldham, Conroe, TX (US); Danielle M. Fuselier, Spring, TX (US); Jim Powers, Edmond, OK (US); Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 367 days.

(21) Appl. No.: 12/832,823

(22) Filed: Jul. 8, 2010

(65) Prior Publication Data

US 2011/0031031 A1 Feb. 10, 2011

Related U.S. Application Data

(60) Provisional application No. 61/223,748, filed on Jul. 8, 2009.

(51) Int. Cl.

| | |
|---|---|
| ***E21B 10/573*** | (2006.01) |
| ***C22C 26/00*** | (2006.01) |
| ***E21B 10/567*** | (2006.01) |

(52) U.S. Cl.

CPC ..... *E21B 10/573* (2013.01); *C22C 26/00* (2013.01); *E21B 10/567* (2013.01); *C22C 2204/00* (2013.01)

USPC ..... 175/432; 175/434; 175/426; 175/428

(58) Field of Classification Search

USPC ..... 175/374, 426, 428, 432, 434

See application file for complete search history.

(56) References Cited

U.S. PATENT DOCUMENTS

| | | | | |
|---|---|---|---|---|
| 2,947,609 | A | 8/1960 | Strong | |
| 3,596,649 | A * | 8/1971 | Olivieri | 125/11.01 |
| 4,128,136 | A | 12/1978 | Generoux | |
| 4,186,628 | A | 2/1980 | Bonnice | |
| 4,255,165 | A | 3/1981 | Dennis et al. | |
| 4,299,471 | A | 11/1981 | Alex et al. | |

(Continued)

FOREIGN PATENT DOCUMENTS

| | | | |
|---|---|---|---|
| EP | 0546725 | A1 | 6/1993 |
| EP | 0582484 | A1 | 2/1994 |
| EP | 0501447 | B1 | 11/2000 |
| EP | 0733776 | B1 | 9/2003 |
| EP | 1052367 | | 4/2005 |

(Continued)

OTHER PUBLICATIONS

"US Synthetic Basics of PCD Manufacturing Training Course", Orem, Utah; Oct. 2003 (34 pages).

(Continued)

*Primary Examiner* — William P Neuder
*Assistant Examiner* — Richard Alker
(74) *Attorney, Agent, or Firm* — TraskBritt

(57) ABSTRACT

A cutting element for use in a drill bit for drilling subterranean formations includes a cutting body having a substrate including a rear surface, an upper surface, and a peripheral side surface extending between the rear surface and the upper surface, and a superabrasive layer overlying the upper surface of the substrate. The cutting element further includes a sleeve surrounding the peripheral side surface of the cutting body and comprising a superabrasive layer bonded to an external surface of the sleeve.

22 Claims, 11 Drawing Sheets

(56) References Cited

U.S. PATENT DOCUMENTS 4,351,401 A 9/1982 Fielder
4,385,907 A 5/1983 Tomita et al.
4,471,845 A 9/1984 Jurgens
4,478,298 A 10/1984 Hake et al.
4,592,433 A 6/1986 Dennis
4,604,106 A 8/1986 Hall et al.
4,662,896 A 5/1987 Dennis
4,676,124 A 6/1987 Fischer
4,718,505 A 1/1988 Fuller
4,764,255 A 8/1988 Fischer et al.
4,797,138 A 1/1989 Komanduri
4,828,436 A 5/1989 Briese
4,850,523 A 7/1989 Slutz
4,861,350 A 8/1989 Phaal et al.
4,866,885 A 9/1989 Dodsworth
4,919,220 A 4/1990 Fuller et al.
4,932,484 A 6/1990 Warren et al.
4,987,800 A 1/1991 Gasan et al.
4,991,670 A 2/1991 Fuller et al.
4,993,888 A 2/1991 Briese
4,997,049 A 3/1991 Tank et al.
5,025,873 A 6/1991 Cerkovnik
5,028,177 A 7/1991 Meskin et al.
5,030,276 A 7/1991 Sung et al.
5,049,164 A 9/1991 Horton et al.
5,057,124 A 10/1991 Cerceau
5,116,568 A 5/1992 Sung et al.
5,119,714 A 6/1992 Scott et al.
5,147,001 A 9/1992 Chow et al.
5,154,245 A 10/1992 Waldenstrom et al.
5,159,857 A 11/1992 Jurewicz
5,173,090 A 12/1992 Scott et al.
5,199,832 A 4/1993 Meskin et al.
5,217,081 A 6/1993 Waldenstrom et al.
5,232,320 A 8/1993 Tank et al.
5,238,074 A 8/1993 Tibbitts et al.
5,248,317 A 9/1993 Tank et al.
5,264,283 A 11/1993 Waldenstrom et al.
5,273,125 A 12/1993 Jurewicz
5,282,513 A 2/1994 Jones
5,299,471 A 4/1994 Tank et al.
5,370,717 A 12/1994 Lloyd et al.
5,421,423 A 6/1995 Huffstutler
5,431,239 A 7/1995 Tibbitts et al.
5,433,778 A 7/1995 Sleight
5,435,403 A 7/1995 Tibbitts
5,437,343 A 8/1995 Cooley et al.
5,492,188 A * 2/1996 Smith et al. ..... 175/432
5,499,688 A 3/1996 Dennis
5,514,360 A 5/1996 Sleight et al.
5,535,838 A 7/1996 Kashavan et al.
5,549,171 A 8/1996 Mensa-Wilmot et al.
5,551,522 A 9/1996 Keith et al.
5,582,261 A 12/1996 Keith et al.
5,651,421 A 7/1997 Newton et al.
5,667,028 A 9/1997 Truax et al.
5,678,645 A 10/1997 Tibbitts et al.
5,706,906 A 1/1998 Jurewicz et al.
5,720,357 A 2/1998 Fuller et al.
5,722,497 A 3/1998 Gum et al.
5,740,874 A 4/1998 Matthias
5,755,299 A 5/1998 Langford, Jr. et al.
5,776,550 A 7/1998 Disam et al.
5,816,346 A 10/1998 Beaton et al.
5,819,862 A * 10/1998 Matthias et al. ..... 175/428
5,871,060 A 2/1999 Jensen et al.
5,881,830 A 3/1999 Cooley
5,904,213 A 5/1999 Caraway et al.
5,906,245 A 5/1999 Tibbitts et al.
5,919,720 A 7/1999 Sleight et al.
5,924,501 A 7/1999 Tibbitts
5,947,609 A 9/1999 Lee
5,960,896 A 10/1999 Barr et al.
5,967,249 A 10/1999 Butcher
5,974,609 A 11/1999 Nunez et al.
5,975,811 A 11/1999 Briese
5,979,571 A 11/1999 Scott et al.
5,979,578 A 11/1999 Packer
5,979,579 A 11/1999 Jurewicz
6,000,483 A 12/1999 Jurewicz et al.
6,003,623 A 12/1999 Miess
6,009,962 A 1/2000 Beaton
6,068,071 A 5/2000 Jurewicz
6,077,591 A 6/2000 Griffin et al.
6,082,223 A 7/2000 Tibbitts
6,098,729 A 8/2000 Matthias
6,102,140 A 8/2000 Boyce et al.
6,123,161 A 9/2000 Taylor
6,132,676 A 10/2000 Holzer et al.
6,145,607 A 11/2000 Griffin et al.
6,148,938 A 11/2000 Beaton
6,164,394 A 12/2000 Mensa-Wilmot et al.
6,183,716 B1 2/2001 Sleight et al.
6,187,068 B1 * 2/2001 Frushour et al. ..... 51/295
6,187,700 B1 2/2001 Merkel
6,189,634 B1 2/2001 Bertagnolli et al.
6,193,001 B1 2/2001 Eyre et al.
6,202,770 B1 3/2001 Jurewicz et al.
6,202,771 B1 3/2001 Scott et al.
6,216,805 B1 4/2001 Lays et al.
6,218,324 B1 4/2001 Goettler
6,220,375 B1 4/2001 Butcher et al.
6,230,828 B1 5/2001 Beuershausen et al.
6,258,139 B1 7/2001 Jensen
6,258,743 B1 7/2001 Fleming et al.
6,283,233 B1 9/2001 Lamine et al.
6,315,066 B1 11/2001 Dennis
6,326,685 B1 12/2001 Jin et al.
6,401,844 B1 6/2002 Doster et al.
6,401,845 B1 6/2002 Fielder
6,403,511 B2 6/2002 Fleming et al.
6,412,580 B1 7/2002 Chaves
6,439,327 B1 8/2002 Griffin et al.
6,446,740 B2 9/2002 Eyre et al.
6,481,511 B2 11/2002 Griffin et al.
6,510,906 B1 1/2003 Richert et al.
6,521,174 B1 2/2003 Butcher et al.
6,612,383 B2 9/2003 Desai et al.
6,672,406 B2 1/2004 Beuershausen
6,739,417 B2 5/2004 Smith et al.
6,742,611 B1 6/2004 Illerhaus et al.
6,823,952 B1 11/2004 Mensa-Wilmot et al.
6,872,356 B2 3/2005 Butcher et al.
6,892,836 B1 5/2005 Eyre et al.
6,935,444 B2 8/2005 Lund et al.
7,070,011 B2 7/2006 Sherwood, Jr. et al.
7,105,235 B2 9/2006 Lo et al.
7,159,487 B2 1/2007 Mensa-Wilmot et al.
7,188,692 B2 3/2007 Lund et al.
7,237,628 B2 7/2007 Desai et al.
7,350,601 B2 4/2008 Belnap et al.
7,363,992 B2 4/2008 Stowe et al.
7,377,341 B2 5/2008 Middlemiss et al.
7,395,882 B2 7/2008 Oldham et al.
7,462,003 B2 12/2008 Middlemiss
7,473,287 B2 1/2009 Belnap et al.
7,487,849 B2 2/2009 Radtke
7,493,973 B2 2/2009 Keshavan et al.
7,594,553 B2 9/2009 Tank et al.
7,624,818 B2 12/2009 McClain et al.
7,757,793 B2 7/2010 Voronin et al.
7,909,121 B2 3/2011 Voronin et al.
8,210,288 B2 * 7/2012 Chen et al. ..... 175/430
8,309,050 B2 11/2012 Keshavan et al.
2001/0031692 A1 10/2001 Fleming et al.
2003/0084894 A1 5/2003 Sung
2003/0218268 A1 11/2003 Morito et al.
2004/0007394 A1 1/2004 Griffin
2005/0077091 A1 4/2005 Butland et al.
2005/0100743 A1 5/2005 Hougham et al.
2005/0101133 A1 5/2005 Tzeng et al.
2005/0263328 A1 12/2005 Middlemiss
2006/0032677 A1 2/2006 Azar et al.
2006/0060390 A1 3/2006 Eyre

(56) References Cited

U.S. PATENT DOCUMENTS

| | | | |
|---|---|---|---|
| 2006/0070771 | A1 | 4/2006 | McClain et al. |
| 2006/0099895 | A1 | 5/2006 | Tank et al. |
| 2006/0144621 | A1 | 7/2006 | Tank et al. |
| 2006/0162969 | A1 | 7/2006 | Belnap et al. |
| 2006/0191723 | A1 | 8/2006 | Keshavan |
| 2006/0201712 | A1 | 9/2006 | Zhang et al. |
| 2006/0207802 | A1 | 9/2006 | Zhang et al. |
| 2006/0219439 | A1 | 10/2006 | Shen et al. |
| 2006/0254830 | A1 | 11/2006 | Radtke |
| 2006/0266558 | A1 | 11/2006 | Middlemiss et al. |
| 2006/0266559 | A1 | 11/2006 | Keshavan et al. |
| 2007/0029114 | A1 | 2/2007 | Middlemiss |
| 2007/0034416 | A1 | 2/2007 | Cho et al. |
| 2007/0079995 | A1 | 4/2007 | McClain et al. |
| 2007/0135550 | A1 | 6/2007 | Chakrapani et al. |
| 2007/0187155 | A1 | 8/2007 | Middlemiss |
| 2007/0235230 | A1 | 10/2007 | Cuillier et al. |
| 2007/0261890 | A1 | 11/2007 | Cisneros |
| 2007/0267227 | A1 | 11/2007 | Mensa-Wilmot |
| 2007/0278014 | A1 | 12/2007 | Cariveau |
| 2007/0278017 | A1 | 12/2007 | Shen et al. |
| 2007/0284152 | A1 | 12/2007 | Eyre et al. |
| 2008/0010905 | A1 | 1/2008 | Eyre |
| 2008/0023231 | A1 | 1/2008 | Vail |
| 2008/0047484 | A1 | 2/2008 | Sung |
| 2008/0105466 | A1 | 5/2008 | Hoffmaster et al. |
| 2008/0142267 | A1 | 6/2008 | Griffin et al. |
| 2008/0164071 | A1 | 7/2008 | Patel et al. |
| 2008/0179108 | A1 | 7/2008 | McClain et al. |
| 2008/0179109 | A1 | 7/2008 | Belnap et al. |
| 2008/0206576 | A1 | 8/2008 | Qian et al. |
| 2008/0223621 | A1 | 9/2008 | Middlemiss et al. |
| 2008/0236899 | A1 | 10/2008 | Oxford et al. |
| 2008/0236900 | A1 | 10/2008 | Cooley et al. |
| 2008/0264696 | A1 | 10/2008 | Dourfaye et al. |
| 2008/0302575 | A1 | 12/2008 | Durairajan et al. |
| 2008/0308276 | A1 | 12/2008 | Scott |
| 2009/0030658 | A1 | 1/2009 | Durairajan et al. |
| 2009/0032169 | A1 | 2/2009 | Dourfaye et al. |
| 2009/0032571 | A1 | 2/2009 | Smith |
| 2009/0120008 | A1 | 5/2009 | Lockwood et al. |
| 2009/0173014 | A1 | 7/2009 | Voronin et al. |
| 2009/0173548 | A1 | 7/2009 | Voronin et al. |
| 2009/0218146 | A1 | 9/2009 | Fang et al. |
| 2010/0000798 | A1 | 1/2010 | Patel |
| 2010/0012390 | A1 | 1/2010 | Shamburger |
| 2010/0084197 | A1 | 4/2010 | Voronin et al. |
| 2010/0104874 | A1 | 4/2010 | Yong et al. |
| 2010/0288564 | A1 | 11/2010 | Dovalina, Jr. et al. |
| 2010/0300767 | A1 | 12/2010 | Cariveau et al. |
| 2010/0326740 | A1 | 12/2010 | Hall et al. |
| 2010/0326742 | A1 | 12/2010 | Vempati et al. |
| 2011/0017520 | A1 | 1/2011 | Webb |
| 2011/0023377 | A1 | 2/2011 | DiGiovanni |
| 2011/0024200 | A1 | 2/2011 | DiGiovanni et al. |
| 2011/0073379 | A1 | 3/2011 | DiGiovanni et al. |
| 2011/0297450 | A1 | 12/2011 | Can et al. |

FOREIGN PATENT DOCUMENTS

| | | | |
|---|---|---|---|
| JP | 11-165261 | A | 6/1999 |
| KR | 10-0853060 | B1 | 8/2008 |
| WO | 9929465 | A1 | 6/1999 |
| WO | 0211876 | | 2/2002 |
| WO | 2007089590 | A2 | 8/2007 |
| WO | 2007148060 | A1 | 12/2007 |
| WO | 2010097784 | A1 | 9/2010 |

OTHER PUBLICATIONS

Dan Scott; "The History and Impact of Synthetic Diamond Cutters and Diamond Enhanced Inserts on the Oil and Gas Industry"; Industrial Diamond Review Jan. 2006 (11 pages).

Karasawa, Hirokazu. "Laboratory Testing to Design PDC Bits for Geothermal Well Drilling." National Institute for Resources and Environment . 40. (1992): 135-141.

U.S. Appl. No. 12/832,817, filed Jul. 8, 2010, Inventors: Anthony A. DiGiovanni et al.

Cetinkol, Mehmet et al. "Pressure dependence of negative thermal expansion in Zr2(WO4)(PO4)2." Solid State Communication. 149. (2009): 421-424.

Catafesta, Jadna. "Tunable Linear Thermal Expansion Coefficient of Amorphous Zirconium Tungstate." Journal of the American Cermamic Society. 89.7 (2006): 2341-2344.

Grzechnik, Andrzej et al. "Structural transformations in cubic ZrMo2O8 at high pressures and high temperatures." Solid State Sciences. 4. (2002): 1137-1141.

Chen, B et al. "High-pressure optical study of HfW2O8." Journal of Physics:Condensed Matter. 14. (2002): 13911-13916.

Ravindran, T.R. et al. "High Pressure Behavior of ZrW2O8: Gruneisen Parameter and Thermal Properties." American Physical Society: Physical Review Letters. 84.17 (2000): 3879-3882.

Ravindran, T.R. et al. "Erratum: High Pressure Behavior of ZrW2O8: Gruneisen Parameter and Thermal Properties." American Physical Society: Physical Review Letters. 85.1 (2000): 225.

Sleight, Arthur W. "Negative thermal expansion material." Current Opinion in Solid State & Materials Science. 3. (1998): 128-131.

Bertagnolli, K. E., and Vale, R., 2000, "Understanding and Controlling Residual Stresses in Thick Polycrystalline Diamond Cutters for Enhanced Durability," Proceedings, INTERTECH 2000: An International Technical Conference on Diamond,Cubic Boron Nitride and their Applications, Vancouver, BC, Jul. 17-21, 2000.

David, W.I.F., Evans, J.S.O., and Sleight, A.W., "Zirconium Tungstate: The Incredible Shrinking Material," 1997 ISIS Laboratory Scientific Highlights.

Clegg, J. "Faster and Longer Bit Runs With New-Generation PDC Cutter." Journal of Petroleum Technology. 58.12 (2006): 73-75.

R.L. Mehan et al., "Thermal Degradation of Sintered Diamond Compacts," Materials Research Laboratory, Report No. 88CRD041, Manuscript received Feb. 8, 1988, 20 pages.

Fran Cverna (Technical Editor), "Thermal Properties of Metals: Chapter 2—Thermal Expansion," ASM International, <http://www.asminternational.org>, ASM Ready Reference: Thermal Properties of Metals, Product Code: 06702G, 2002, 9 pages.

The International Search Report and the Written Opinion for International Application No. PCT/US2010/043416 received from the International Searching Authority (ISA/KR) dated Mar. 2, 2011, 9 pages.

The International Search Report and the Written Opinion for International Application No. PCT/US2010/033517 received from the International Searching Authority (ISA/KR) dated Jan. 10, 2011, 8 pages.

The International Search Report and the Written Opinion for International Application No. PCT/US2010/041413 received from the International Searching Authority (ISA/KR) dated Feb. 21, 2011, 12 pages.

The International Search Report and the Written Opinion for International Application No. PCT/US2010/039794 received from the International Authority (ISA/KR) dated Feb. 8, 2011, 6 pages.

The International Search Report and the Written Opinion for International Application No. PCT/US2010/041411 received from the International Searching Authority (ISA/KR) dated Feb. 21, 2011, 9 pages.

The International Search Report and the Written Opinion for International Application No. PCT/US2010/050252 received from the International Searching Authority (ISA/KR) dated Apr. 27, 2011, 13 pages.

* cited by examiner

CUTTING ELEMENT FOR A DRILL BIT USED IN DRILLING SUBTERRANEAN FORMATIONS

CROSS-REFERENCE TO RELATED APPLICATION

The present application claims priority to U.S. Provisional Patent Application No. 61/223,748, filed Jul. 8, 2009, titled "Cutting Element for a Drill Bit Used in Drilling Subterranean Formations," which application is incorporated by reference herein in its entirety.

BACKGROUND

1. Field of the Disclosure

The following disclosure is directed to cutting elements for use in drill bits, and particularly cutting elements incorporating a cutting body and a sleeve.

2. Description of the Related Art

In the past, rotary drill bits have incorporated cutting elements employing superabrasive materials. Within the industry there has been widespread use of synthetic diamond cutters using polycrystalline diamond compacts, otherwise termed "PDC" cutters. Such PDC cutters may be self supported, otherwise a monolithic object made of the desired material, or incorporate a polycrystalline diamond layer or "table" on a substrate made of a hard metal material suitable for supporting the diamond layer.

However, PDC cutter designs continue to face obstacles. For example, mechanical strains are commonplace given the significant loading on the cutters. Moreover, in extreme conditions, delamination and fracture of the cutters can occur given the extreme loading and temperatures generated during a drilling operation. Furthermore, failure of the cutters due to temperature concerns can go beyond the existence of simply encountering high temperatures, but the effects of heating and cooling on the cutters and the resultant failure of the cutters due to differences in thermal expansion coefficient and thermal conductivity of materials within the cutter.

Various different configurations of cutters have been used to mitigate the effects of mechanical strain and temperature-induced wear characteristics. However significant shortcomings are still exhibited by conventional cutters.

SUMMARY

According to one aspect, a cutting element for use in a drill bit for drilling subterranean formations includes a cutting body comprising a substrate having a rear surface, an upper surface, and a peripheral side surface extending between the rear surface and the upper surface, a superabrasive layer overlying the upper surface of the substrate, and a sleeve surrounding at least a portion of the peripheral side surface of the cutting body and having a superabrasive layer bonded to an external surface of the sleeve.

In accordance with another aspect, a cutting element for use in a drill bit for drilling subterranean formations includes a cutting body comprising a substrate having a rear surface, an upper surface, and a peripheral side surface extending between the rear surface and the upper surface, a superabrasive layer overlying the upper surface of the substrate, and a sleeve surrounding the peripheral side surface of the cutting body. The cutting element further incorporates an interface layer disposed between the cutting body and the sleeve.

According to another aspect, a cutting element for use in a drill bit for drilling subterranean formations includes a cutting body comprising a substrate having a rear surface, an upper surface, and a peripheral side surface extending between the rear surface and upper surface, a superabrasive layer overlying the upper surface of the substrate, and a sleeve surrounding the peripheral side surface of the substrate, wherein the sleeve has an upper surface, a side surface, and a chamfered surface angled with respect to the upper surface of the sleeve.

In still another aspect, a cutting element for use in a drill bit for drilling subterranean formations includes a cutting body comprising a substrate having a rear surface, an upper surface, and a peripheral side surface extending between the rear surface and upper surface, a superabrasive layer overlying an upper surface of the substrate, and a sleeve mechanically connected to the peripheral side surface of the substrate, wherein the sleeve and cutting body are mechanically connected through a connection selected from the group of connections comprising an interlocking-fit connection, an interference-fit connection, a grooved connection, a threaded connection, a taper-lock connections and a combination thereof.

According to another aspect, a method of forming a cutting element for use in a drill bit for drilling subterranean formations includes forming a cutting body having a substrate having a rear surface, an upper surface, and a peripheral side surface extending between the rear surface and the upper surface, and a superabrasive layer overlying the upper surface of the substrate, and forming a sleeve comprising a body and a superabrasive layer formed on an external surface of the body, wherein the sleeve comprises an annular shape having a central opening defined by an inner surface. The method further includes forming a cutting element comprising the cutting body disposed within the central opening of the sleeve.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is directed to earth boring drill bits, and more particularly, cutting elements used in such drill bits. The following describes cutting elements and methods of forming such elements such that they may be incorporated within drill bits. The terms "bit," "drill bit," and "matrix drill bit," may be used in this application to refer to "rotary drag bits," "drag bits," "fixed-cutter drill bits" or any other earth boring drill bit incorporating the teachings of the present disclosure. Such drill bits may be used to form well bores or boreholes in subterranean formations.

Figure 1:
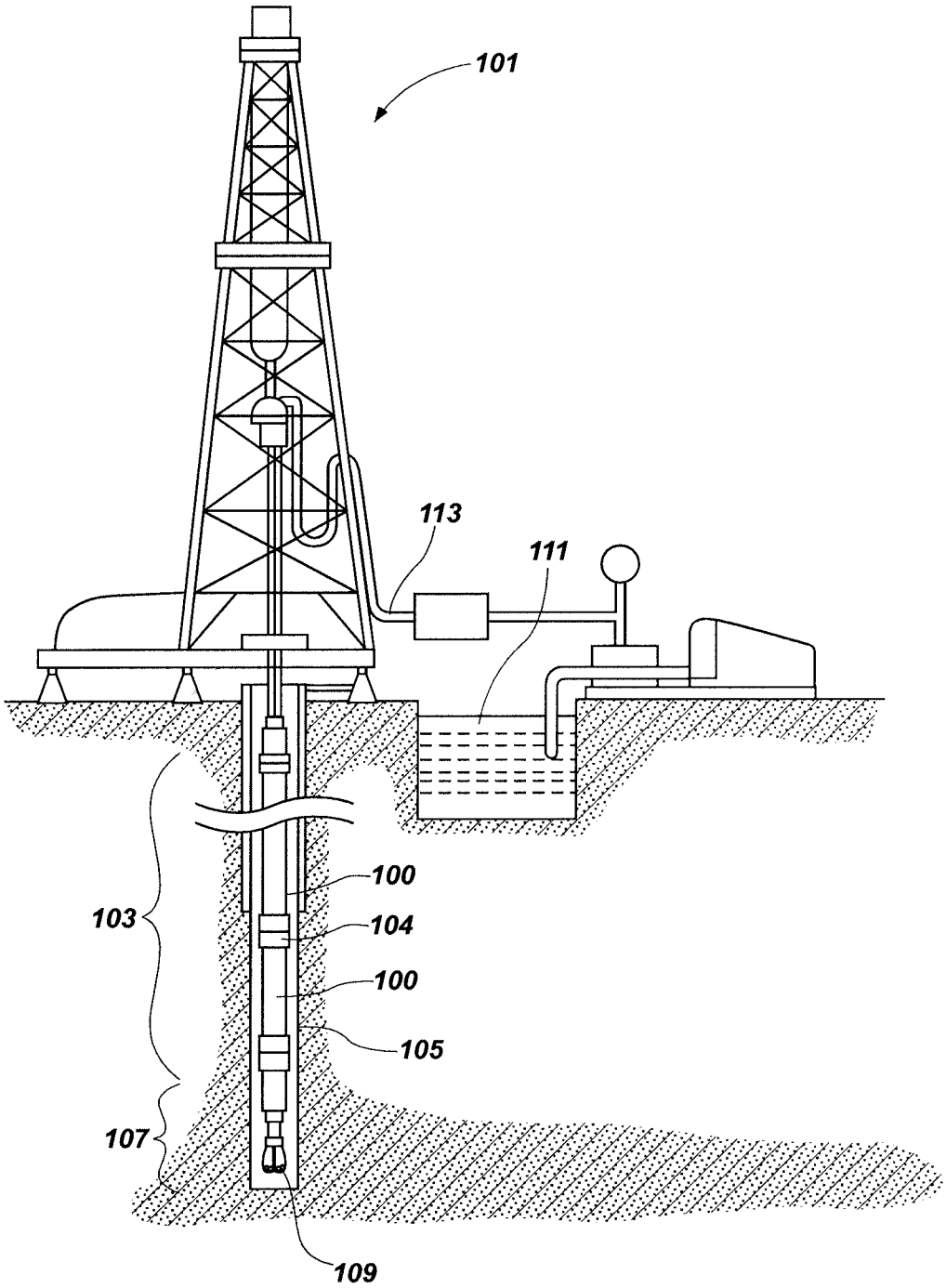
FIG. 1 includes an illustration of a subterranean drilling operation.

An example of a drilling system for drilling such well bores in earth formations is illustrated in FIG. 1. In particular, FIG. 1 illustrates a drilling system including a drilling rig 101 at the surface, serving as a station for workers to operate a drill string 103. The drill string 103 defines a well bore 105 extending into the earth and can include a series of drill pipes 100 that are coupled together via joints 104, facilitating extension of the drill string 103 for depths into the well bore 105. The drill string 103 may include additional components, such as tool joints, a kelly, kelly cocks, a kelly saver sub, blowout preventers, safety valves, and other components known in the art.

Moreover, the drill string can be coupled to a bottom-hole assembly (BHA) 107 including a drill bit 109 used to penetrate earth formations and extend the depth of the well bore 105. The BHA 107 may further include one or more drill collars, stabilizers, a downhole motor, MWD tools, LWD tools, jars, accelerators, push and pull directional drilling tools, point stab tools, shock absorbers, bent subs, pup joints, reamers, valves, and other components. A fluid reservoir 111 is also present at the surface that holds an amount of liquid that can be delivered to the drill string 103, and particularly the drill bit 109, via pipes 113, to facilitate the drilling procedure.

Figure 2:
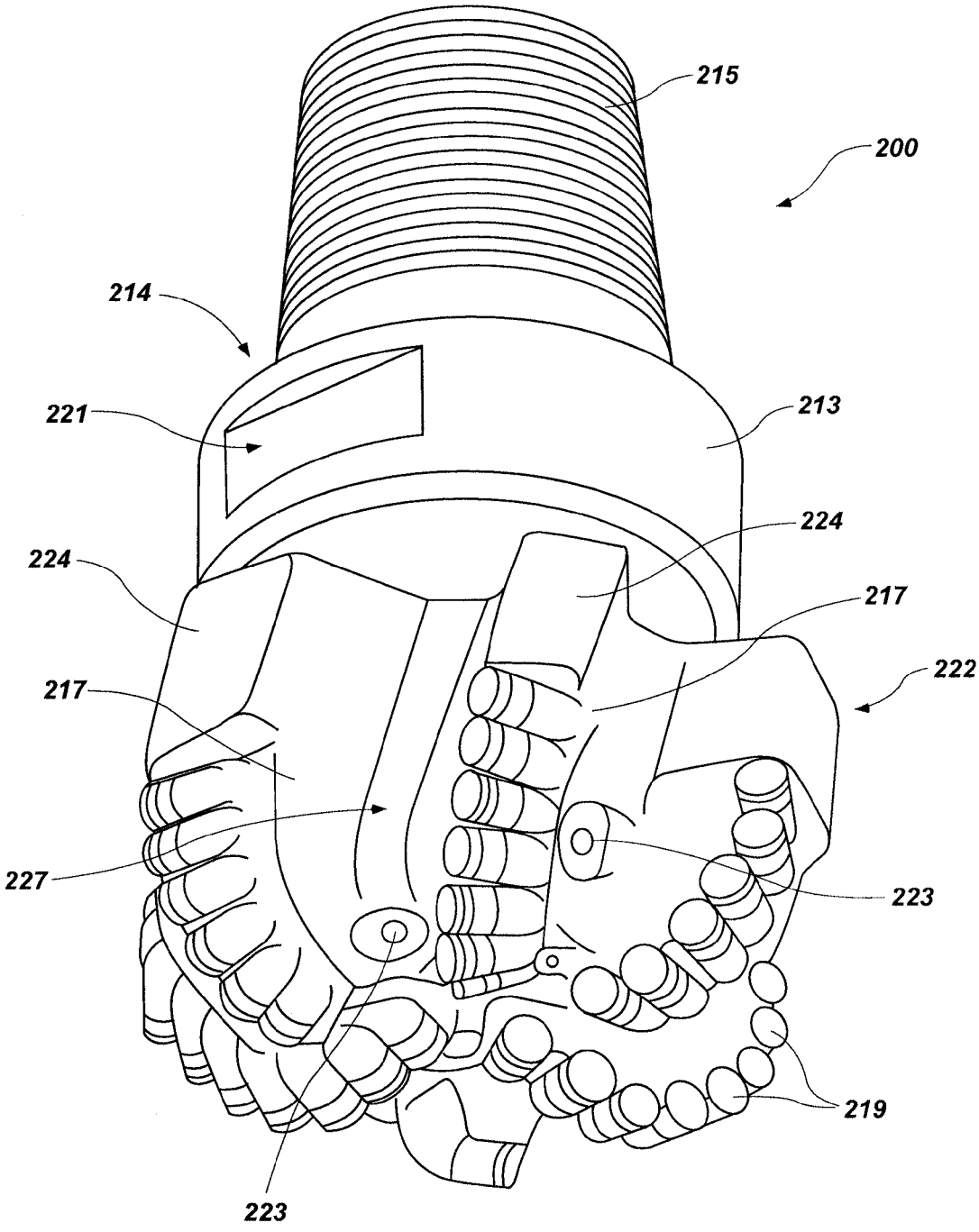
FIG. 2 includes an illustration of a drill bit in accordance with an embodiment.

FIG. 2 includes a perspective view of a fixed cutter drill bit according to an embodiment. The fixed-cutter drill bit 200 has a bit body 213 that can be connected to a shank portion 214 via a weld. The shank portion 214 includes a threaded portion 215 for connection of the drill bit 200 to other components of the BHA 107, as shown in FIG. 1. The bit body 213 of drill bit 200 can further include a breaker slot 221 extending laterally along the circumference of the bit body 213 of drill bit 200 to aid coupling and decoupling of the drill bit 200 to other components.

The drill bit 200 includes a crown portion 222 coupled to the bit body 213. As will be appreciated, the crown portion 222 can be integrally formed with the bit body 213 of drill bit 200 such that they are a single, monolithic piece. The crown portion 222 can include gage pads 224 situated along the sides of protrusions or blades 217 that extend radially from the crown portion 222. Each of the blades 217 extend from the crown portion 222 and include a plurality of cutting elements 219 bonded to the blades 217 for cutting, scraping, and shearing through earth formations when the drill bit 200 is rotated during drilling. The cutting elements 219 may be tungsten carbide inserts, polycrystalline diamond compacts (PDCs), milled steel teeth, or any of the cutting elements described herein. Coatings or hardfacings may be applied to the cutting elements 219 and other portions of the bit body 213 or crown portion 222 to reduce wear and increase the life of the drill bit 200.

The crown portion 222 can further include junk slots 227 or channels formed between the blades 217 that facilitate fluid flow and removal of cuttings and debris from the well bore. Notably, the junk slots 227 can further include openings 223 for passages extending through the interior of the crown portion 222 and bit body 213 for communication of drilling fluid through the drill bit 200. The openings 223 can be positioned at exterior surfaces of the crown portion 222 at various angles for dynamic fluid flow conditions and effective removal of debris from the cutting region during drilling.

Figure 3A:
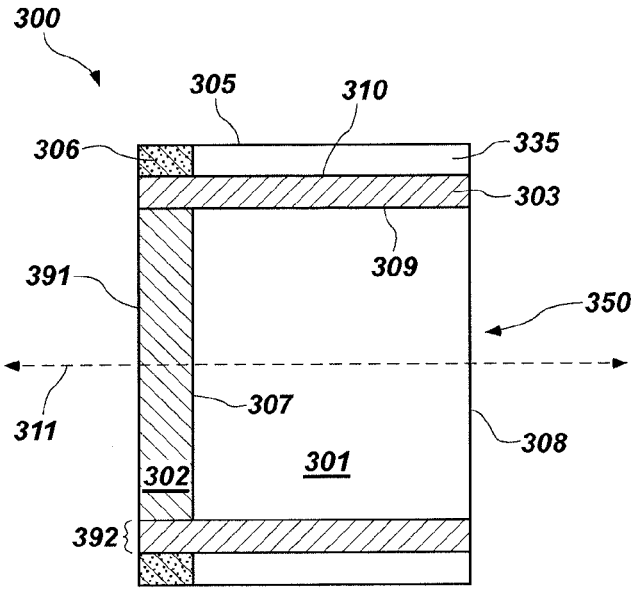
FIGS. 3A-3C include cross-sectional illustrations and a perspective view of cutter elements in accordance with embodiments.
Figure 3B:
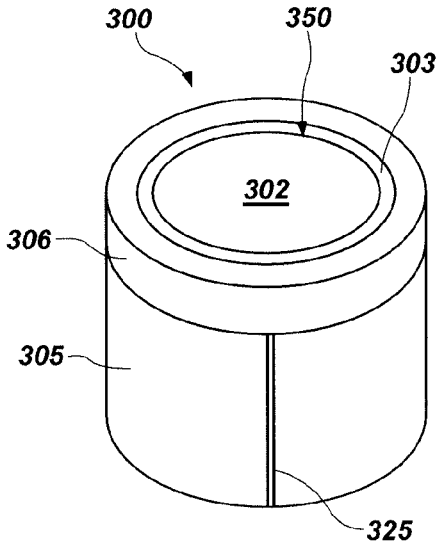
Figure 3C:
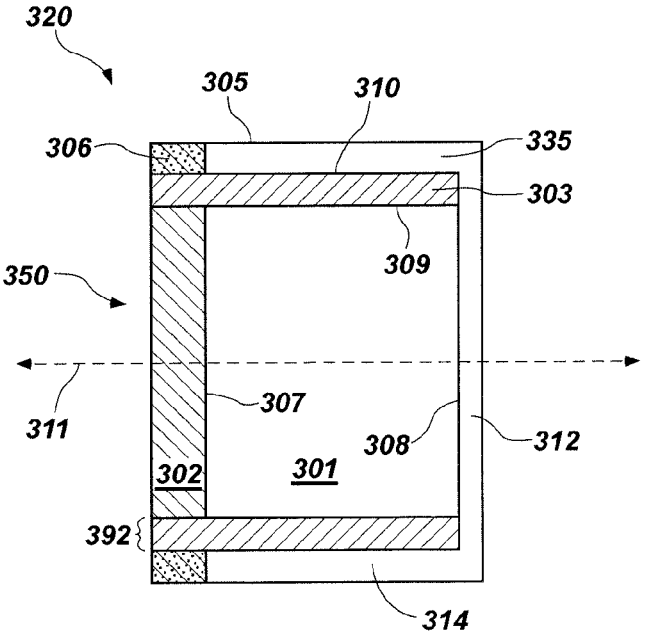

FIGS. 3A-3C include cross-sectional illustrations and a perspective illustration of cutting elements in accordance with embodiments. Referring to FIG. 3A, a cross-sectional illustration of a cutting element is provided in accordance with an embodiment. The cutting element 300 includes a cutting body 350 having a substrate 301 that provides a suitable object upon which a superabrasive layer 302 can be formed as will be described herein. The substrate 301 can have a shape comprising an elongated portion defining a length extending along a longitudinal axis 311. In certain designs, the substrate 301 has a rear surface 308, an upper surface 307, and a peripheral side surface 309 that extends between the rear surface 308 and upper surface 307. The peripheral side surface 309 can have an arcuate shape in a radial manner extending around the substrate 301 in a direction perpendicular to the longitudinal axis 311. For instance, the substrate 301 may have a cylindrical shape, such that it has a circular cross-sectional contour as viewed in cross-section to the longitudinal axis 311. It will be appreciated that alternative shapes for the substrate 301 and the cutting element 300 are possible, including polygonal cross-sectional contours (e.g., rectangular, trapezoidal, pentagonal, etc.), elliptical cross-sectional contours, hemispherical cross-sectional contours, and the like. Accordingly, it will be further appreciated that reference herein to a circumference with regard to a cutting element or any of its components is reference to a dimension extending around the periphery of the identified article in instances where the cutter has a cross-sectional contour other than that of a circle.

The substrate 301 can have a hardness suitable for withstanding drilling operations. That is, certain substrates 301 can be made of a material having a Mohs hardness of at least about 8, or at least about 8.5, at least about 9.0, or even at least about 9.5. Particular metals or metal alloy materials may be incorporated in the substrate 301. For example, the substrate 301 can be formed of carbides, nitrides, oxides, borides, carbon-based materials, and a combination thereof. In some instances, the substrate 301 may be made of a cemented material such as a cemented carbide. Some suitable cemented carbides may include metal carbides, and more particularly cemented tungsten carbide such that the substrate 301 consists essentially of tungsten carbide.

Referring again to FIG. 3A, the substrate 301 can have a shape such that the rear surface 308 and upper surface 307 are substantially parallel to each other. Moreover, the substrate 301 can have a shape such that the upper surface 307 is suitably formed to have an overlying superabrasive layer 302. In particular instances, the superabrasive layer 302 is directly contacting, and even directly bonded to, the upper surface 307 of the substrate 301. The superabrasive layer 302 may be formed on the upper surface 307 of the substrate 301, such that it extends transversely to the longitudinal axis 311 and substantially covers the entire upper surface 307 of the substrate 301.

The superabrasive layer 302 can include superabrasive materials such as diamond, boron nitride, carbon-based materials, and a combination thereof. Some superabrasive layers may be in the form of polycrystalline materials. For instance, the superabrasive layer 302 can consist essentially of polycrystalline diamond. With reference to those embodiments using polycrystalline diamond, the superabrasive layer 302 can be made of various types of diamond including thermally stable polycrystalline diamond, which generally contain a lesser amount of catalyst materials (e.g., cobalt) than other diamond materials, making the material stable at higher temperatures.

A sleeve 305 can be disposed around the substrate 301 such that it surrounds at least a portion of the peripheral side surface 309 of the substrate 301. That is, in certain embodiments, the sleeve 305 can surround a portion of the peripheral side surface 309, such that it extends for less than the full dimension of the peripheral side surface around the longitudinal axis 311 (i.e., less than 360 degrees of coverage). Moreover, the sleeve 305 can be separated into sleeve portions, such as two sleeve portions, three sleeve portions, or more, wherein each of the sleeve portions extend for a fraction of the distance around the periphery of the peripheral side surface 309. In other designs, the sleeve 305 is situated such that extends around the entirety of the periphery of the peripheral side surface 309. In particular, the sleeve 305 is shaped such having a generally annular shape containing a central opening defined by an inner surface 310, such that the cutting body 350 can be disposed within the central opening and the sleeve 305 surrounds the peripheral side surface 309 of the cutting body 350.

Certain cutting elements can utilize a sleeve 305 that extends along the entire axial length of the substrate 301 as defined by the longitudinal axis 311 between the upper surface 307 and the rear surface 308 of the substrate 301. Still, in other embodiments, the sleeve 305 is configured to extend along the full length of the cutting body 350 such that it extends from an upper surface 391 of the superabrasive layer 302 to the rear surface 308 of the substrate 301. The sleeve 305 can have a length of at least about 30%, such as at least about 50%, at least about 60%, at least about 75%, or even at least about 90% of the total length of the cutting body 350. In particular instances, the length of the sleeve 305 is within a range between about 30% and about 125% of the total length of the cutting body 350, such as within a range between about 40% and about 110%, between about 50% and about 100%, or even between about 50% and about 90% of the total length of the cutting body 350.

Moreover, as illustrated, the sleeve 305 can be fixated such that a gap 392 can be present that extends axially along the length of the cutting body 350 (i.e., along the longitudinal axis 311) between the peripheral side surface 309 of the substrate 301 and the inner surface 310 of the sleeve 305. The gap 392 may facilitate the inclusion of an interface layer 303 described in more detail herein. Notably, the sleeve 305 and the cutting body 350 can be formed such that the gap 392 can have a particularly uniform width along its length. In still other embodiments, the gap 392, as defined by the peripheral side surface 309 of the substrate 301 and the inner surface 310 of the sleeve 305, can have various surface features including axially and/or radially extending protrusions, axially and/or radially extending ridges, axially and/or radially extending recesses, axially and/or radially extending curvatures, and the like, to improve the connection between the sleeve 305 and the cutting body 350.

In some designs, the sleeve 305 can be formed such that it has a superabrasive layer 306 overlying an external surface. The superabrasive layer 306 can be overlying, and even directly contacting or bonded to an external surface of the sleeve 305, and particularly the sleeve body portion 335. The superabrasive layer 306 can include the same materials and have the same features as the superabrasive layer 302 of the cutting body 350.

It will also be appreciated that the superabrasive layer 306 can be made of a different material than the superabrasive layer 302, or even, comprise the same material and yet have different material characteristics than the superabrasive layer 302. For example, in one embodiment, the superabrasive layers 302 and 306 can be formed of a diamond material (e.g., PDC or TSP), wherein the superabrasive layer 302 is formed from a different diamond feed material than the superabrasive layer 306. The diamond feed refers to the initial (i.e., raw) diamond material that is used to form the superabrasive layers. The diamond feed material can be varied to control performance characteristics of the as-formed superabrasive layer. For example, the size distribution of the diamond grains, quality of diamond grains, and the like can be varied to affect toughness, abrasiveness, and other mechanical characteristics. As such, in certain embodiments, the superabrasive layer 306 can be formed of a diamond feed material configured to form a superabrasive layer 306 having a toughness greater than the superabrasive layer 302. Yet, in other embodiments, the superabrasive layer 306 can be formed from a diamond feed configured to form a superabrasive layer 306 having a greater abrasiveness as compared to the superabrasive layer 302.

Certain cutting elements utilize a sleeve body portion 335 that can be made of a metal or metal alloy material. For example, the sleeve body portion 335 can be made of a material such as a carbide, nitride, boride, oxide, carbon-based material, and a combination thereof. In accordance with one particular embodiment, the sleeve body portion 335 is formed such that it consists essentially of a carbide material, and more particularly, a tungsten carbide material.

Still, some cutting elements can be formed such that sleeve 305 is made of the same material as the substrate 301. That is, in some designs, the sleeve 305 and substrate 301 can be made of exactly the same composition. Still, in other embodiments, the sleeve 305 and substrate 301 may be formed such that they comprise a different material. For example, the sleeve 305 and substrate 301 may be carbides, however, the sleeve 305 may be formed of a carbide having a different composition than that of the substrate 301. That is, the sleeve 305 can be formed such that it contains a different element, such as a different metal species. In still other embodiments, the sleeve 305 can be made from a completely different material having an entirely distinct composition than that of the substrate 301.

FIG. 3A further illustrates an interface layer 303 that is disposed between the sleeve 305 and the cutting body 350. In particular, the interface layer 303 can be formed such that it is disposed along the inner surface 310 of the sleeve 305, and the peripheral side surface 309 of the substrate 301 and cutting body 350 to mitigate mechanical strains (e.g., wear, cracking, etc.) within the cutting element 300. Some cutting elements can be formed such that the interface layer 303 is disposed in a particular arrangement between the sleeve 305 and the cutting body 350. In more particular instances, the interface layer 303 can be directly contacting and even directly bonded to the inner surface 310 of the sleeve 305 and/or the peripheral side surface 309 of the substrate 301.

The interface layer 303 can be formed of a material having a Mohs hardness that is less than the hardness of the substrate 301. That is, the interface layer 303 may be formed of a material having a lower stiffness than that of the sleeve 305 or substrate 301 or even the abrasive layer 302 such that it facilitates absorbing impacts and prevents damage (e.g., cracking) within the cutter. In certain instances, the cutting element 300 can include an interface layer 303 that is made of a carbide, nitride, boride, oxide, carbon-based material and a combination thereof. For example, the interface layer 303 in certain embodiments may comprise a carbide material, such as a tungsten carbide material, such that the interface layer 303 consists essentially of tungsten carbide. Still, in other embodiments, the interface layer 303 may incorporate a metal or a metal alloy material. Suitable metals can include transition metal elements such as nickel, tin, silver, palladium, copper, zinc, iron, manganese, chromium, tantalum, vanadium, titanium, cobalt, and a combination thereof.

For certain cutting elements, the interface layer 303 can be formed to have some abrasive capabilities. As such, the interface layer 303 can be formed such that it includes an abrasive grit contained within a matrix material. Suitable matrix materials may include a metal or metal alloy material. Additionally, the abrasive grit contained within the matrix material may have a Mohs hardness of at least about 7.0, such as at least about 7.5 or even at least about 8.0 such that is suitable for abrasive operations. Some examples of suitable materials for use as abrasive grit can include oxides, carbides, nitride, borides, and a combination thereof. In particular instances, abrasive grit contained within the matrix material can include silica, alumina, silicon nitride, silicon carbide, cubic boron nitride, diamond, carbon-based materials, or a combination thereof FIG. 3B includes a perspective illustration of a cutting element in accordance with an embodiment. The cutting element 300 is a perspective view of the cutting element illustrated in FIG. 3A, including the cutting body 350, and particularly, the abrasive layer 302, disposed within a central opening of the sleeve 305. Moreover, the cutting element 300 has a generally circular cross-sectional contour as viewed perpendicular to the longitudinal axis of the cutting body 350. However, as will be appreciated in other embodiments, the shape may be altered such that the cutting body 350 can be elliptical or polygonal.

In certain instances, the cutting element 300 may be formed such that the sleeve 305 can have a seam 325 extending along the length of the sleeve 305 in a direction parallel to the longitudinal axis 311 of the cutting element 300. That is, the sleeve 305 can have a split-ring configuration facilitating initial assembly and engagement between the sleeve 305 and the cutting body 350. Moreover, the sleeve 305 can be forged such that it exerts a radially compressive force on the cutting body 350.

FIG. 3C includes a cross-sectional illustration of a cutting element in accordance with an embodiment. The cutting element 320 is similar to the cutting element of FIG. 3A with the distinction that the sleeve 305 comprises a portion that overlies the rear surface 308 of the substrate 301. In particular, the sleeve 305 is formed such that it has a peripheral side 314 that is joined by a bottom side 312 such that the sleeve 305 is cup-shaped. Such a design may facilitate seating and orientation between the cutting element 320 and the sleeve 305. Moreover, as will be appreciated, while the cutting element 320 is illustrated as having an interface layer 303 disposed between the peripheral side surface 309 of the substrate 301 and the inner surface 310 of the sleeve 305, in other embodiments, a portion of the interface layer 303 may be disposed between the rear surface 308 of the substrate 301 and the bottom 312 of the sleeve 305.

Figure 4A:
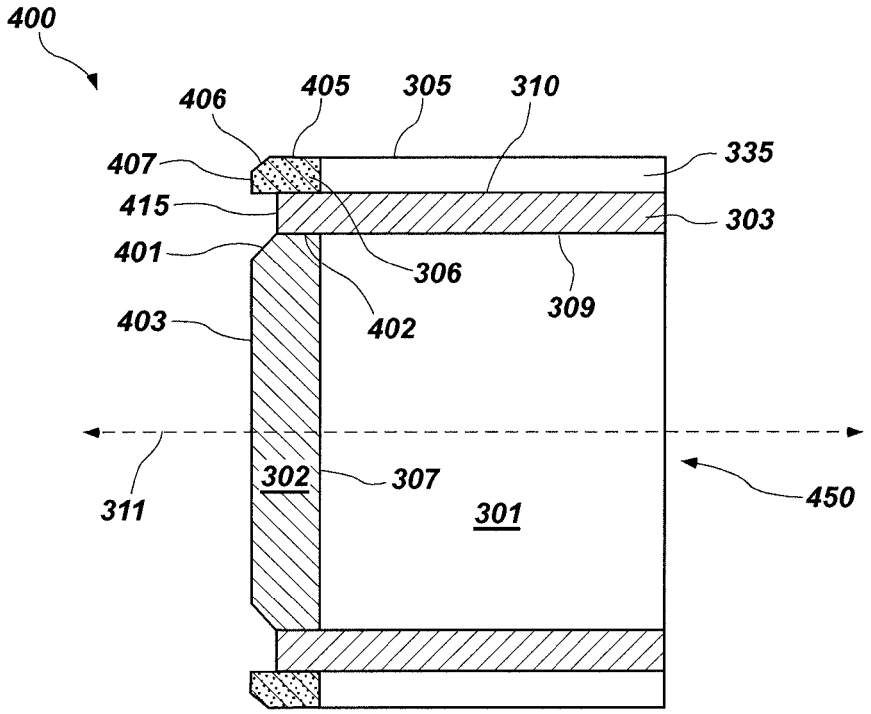
FIGS. 4A-4D include cross-sectional illustrations of cutter elements in accordance with embodiments.

FIGS. 4A-4D include cross-sectional illustrations of different cutting elements in accordance with embodiments. FIG. 4A includes a cross-sectional illustration of one cutting element, including a cutting body 450 comprising a substrate 301 and a superabrasive layer 302 as described herein. Notably, the superabrasive layer 302 includes an upper surface 403 extending transversely to the longitudinal axis 311, a side surface 402 extending parallel to the direction of the longitudinal axis 311 and a chamfered surface 401 extending between the side surface 402 and the upper surface 403 at an angle to the side surface 402 and upper surface 403. Various angles and lengths of the chamfered surface 401 may be employed. As will be appreciated, the chamfered surface 401 may extend as an annulus around the periphery of the top surface 403 through the entire periphery (e.g., circumference) of the side surface 402 of the superabrasive layer 302. However, the chamfered surface 401 may be segmented, such that it is made of discrete portions, wherein each portion extends for a distance less than the entire periphery of the side surface 402. Moreover, in certain instances, it may be desirable to use a radiused edge, that is, an edge having a curvature or arcuate shape that can be defined by a radius. As such, it will be appreciated that references herein to chamfered surfaces will be understood to also include radiused edge configurations.

As further illustrated in FIG. 4A, the cutting element 400 can include a sleeve 305 incorporating a sleeve body portion 335 and a superabrasive layer 306 attached to the sleeve body portion 335. A top surface 407 can extend transversely to the longitudinal axis 311, a side surface 405 can extend parallel to the longitudinal axis 311, and a chamfered surface 406 can extend at an angle to the side surface 405 and top surface 407. Like the chamfered surface 401 of the superabrasive layer 302, the chamfered surface 406 of the superabrasive layer 306 can have various lengths and be oriented at various angles. Furthermore, the chamfered surface 406 can extend as an annulus throughout the entire periphery of the surface of the superabrasive layer 306 (i.e., around the periphery of the sleeve 305).

As further illustrated in FIG. 4A, the top surface 407 of the superabrasive layer 306 and the top surface 403 of the superabrasive layer 302 are substantially parallel to each other in a transverse plane that is perpendicular to the longitudinal axis 311. The cutting element 400 further includes an interface layer 303 that is disposed between the cutting body 450 and the sleeve 305. In certain instances, the cutting element 400 can be formed such that the interface layer 303 has a top surface 415 that terminates at the joint between the chamfered surface 401 and the side surface 402 of the superabrasive layer 302. As such, the top surface 415 of the interface layer 303 is recessed and therein occupies a different axial position than the top surface 407 of the superabrasive layer 306 and top surface 403 of the superabrasive layer 302. Such an orientation between the superabrasive layer 302, interface layer 303 and superabrasive layer 306 presents the superabrasive materials in an orientation forward that of the interface layer 303, which may be suitable for certain cutting operations.

Figure 4B:
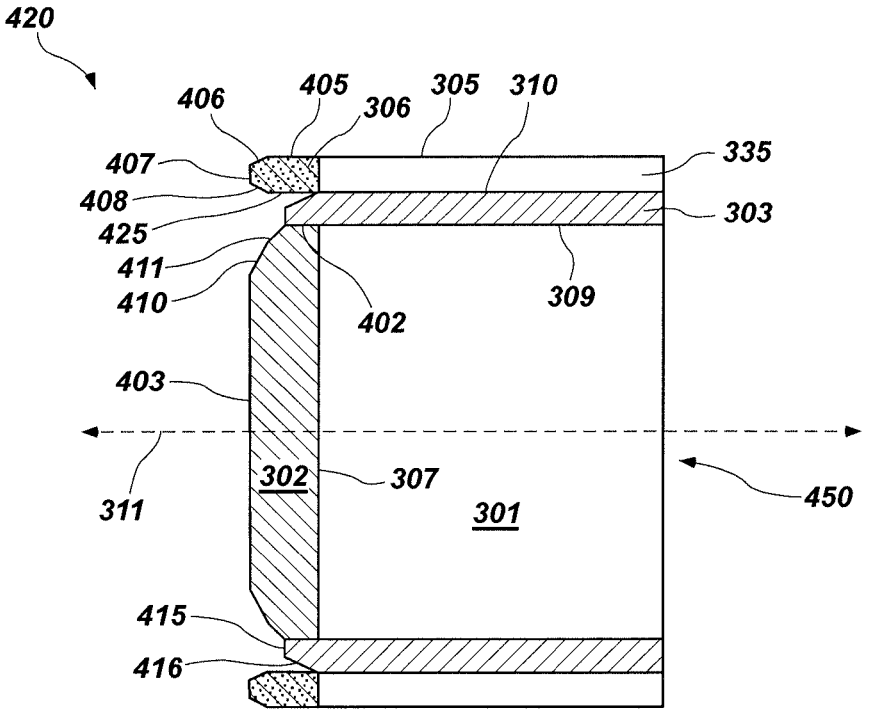

FIG. 4B includes a cross-sectional illustration of a cutting element in accordance with an embodiment. The cutting element 420 includes those components as described herein, including a cutting body 350 employing a substrate 301 and a superabrasive layer 302 bonded to the upper surface of the substrate 301. The superabrasive layer 302 can be formed such that it has a top surface 403, a side surface 402, a first chamfered surface 410 connected to the top surface 403 and a second chamfered surface 411 extending at an angle to the side surface 402 and the first chamfered surface 410. Provision of multiple chamfered surfaces on the superabrasive layer 302 may enhance the cutting ability in various types of subterranean formations. The lengths and angles of the first chamfered surface 410 and the second chamfered surface 411 may be varied depending upon the intended application of the cutting element 420.

As further illustrated in FIG. 4B, the cutting element 420 includes a sleeve 305 surrounding the cutting body 450 that is made of a sleeve body portion 335 and a superabrasive layer 306 connected to the sleeve body portion 335. In particular, the superabrasive layer 335 is formed to have multiple surface features. That is, the superabrasive layer 306 includes a top surface 407, a side surface 405, and a first chamfered surface 406 extending at an angle between the top surface 407 and the side surface 405. Moreover, the superabrasive layer 306 includes a second chamfered surface 408 that extends between the top surface 407 and an inner side surface 425. Provision of multiple chamfered surfaces, such as chamfered surfaces 406, 408 on the superabrasive layer 306 of the sleeve 305 may facilitate improved performance of the cutting element 420 in various subterranean formations. Furthermore, it will be understood that any of the surfaces described as having chamfers herein in any of the embodiments can incorporate multiple chamfers.

As illustrated in FIG. 4B, the cutting element 420 includes an interface layer 303 disposed between the substrate 301 and the sleeve 305. The interface layer 303 can have a top surface 415 that extends transversely to the longitudinal axis 311 and terminates at the junction between the second chamfered surface 411 and side surface 402 of the superabrasive layer 302. Additionally, the interface layer 303 can have a chamfered surface 416 that extends at an angle from the top surface 415. In certain designs, the chamfered surface 416 can extend for a distance until it abuts the inner surface 310 of the sleeve 305.

Figure 4C:
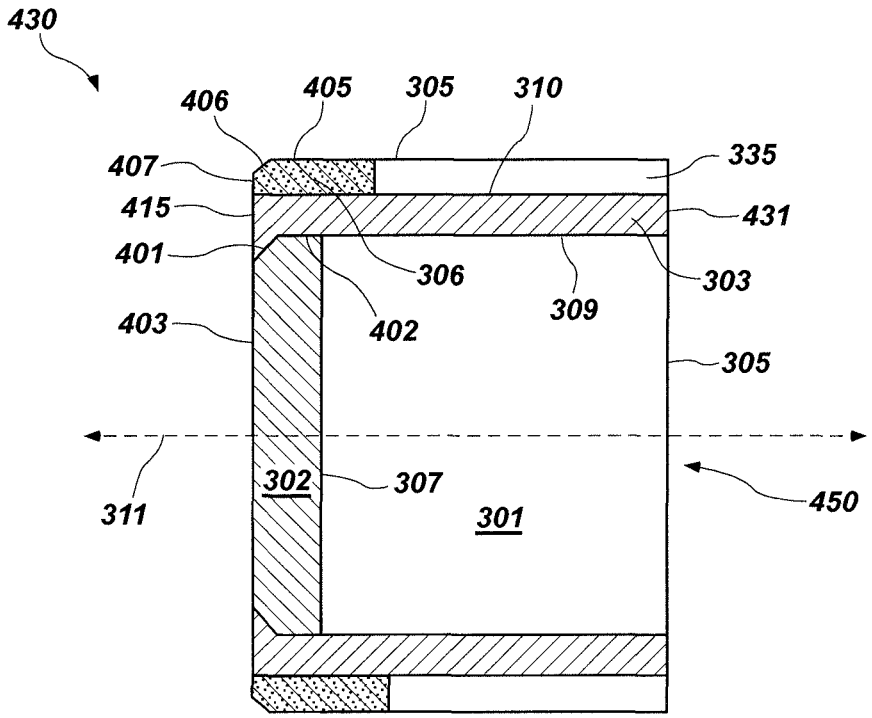

FIG. 4C includes a cross-sectional illustration of a cutting element in accordance with an embodiment. The cutting element 430 includes those components as previously described, however, unlike previous embodiments, the cutting element 430 includes an interface layer 403 having a rear surface 431 coterminous with the rear surface 305 of the substrate 301 and a top surface 415 that is coterminous with the top surface 403 of the superabrasive layer 302 and the top surface 407 of the superabrasive layer 306. Notably, a portion of the interface layer 303 can extend along and cover the chamfered surface 401 and side surface 402 of the superabrasive layer 302.

Figure 4D:
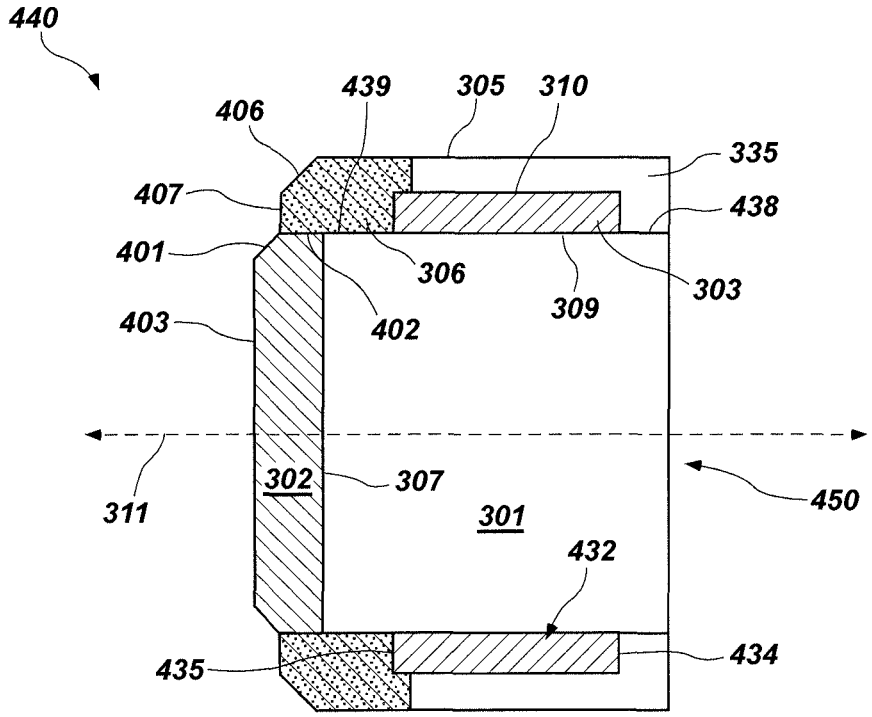

FIG. 4D includes a cross-sectional illustration of a cutting element in accordance with an embodiment. The cutting element 440 is illustrated as having those components as described herein, including a cutting body 450 employing a substrate 301 and a superabrasive layer 302 bonded to an upper surface 307 of the substrate 301. The cutting element 440 further includes a sleeve 305 made of a sleeve body portion 335 and having a portion of superabrasive layer 306 bonded to a surface of the sleeve body portion 335. Notably, the sleeve 305 is formed such that it has a pocket 432, wherein the interface layer 303 is contained therein and surrounded on three sides within the pocket 432. The pocket 432 is defined by a recess within the inner surface 310 and side surfaces 434 and 435 of the sleeve 305. In particular, the sleeve 305 is formed such that it has surfaces 438 and 439 that directly contact and can be bonded to the peripheral side surface 309 of the cutting body 450. As such, the interface layer 303 is disposed between the inner surface 310 and side surfaces 434 and 435 of the sleeve 305 and the peripheral side surface 309 of the cutting body 450.

In addition to the pocket 432, the sleeve 305 can be formed such that the superabrasive layer 306 has a top surface 407, which terminates at a portion of the superabrasive layer 302 of the cutting body 450. In some designs, the superabrasive layer 306 is adjacent to the superabrasive layer 302, and more particularly, the superabrasive layer 306 of the sleeve 305 can be abutting (i.e., directly contacting) the superabrasive layer 302 of the cutting body 450. Generally, in such designs, the superabrasive layer 306 can have a top surface 405 that terminates between the side surface 402 of the superabrasive layer 302 and the chamfered surface 401 of the superabrasive layer 302.

FIGS. 5A-5D illustrate various embodiment of cutting elements. In particular, the cutting elements illustrated in FIGS. 5A-5C demonstrate a relationship between the cutting body, interface layer, and sleeve such that certain arrangements of these components are protruding or recessed in relation to each other.

Figure 5A:
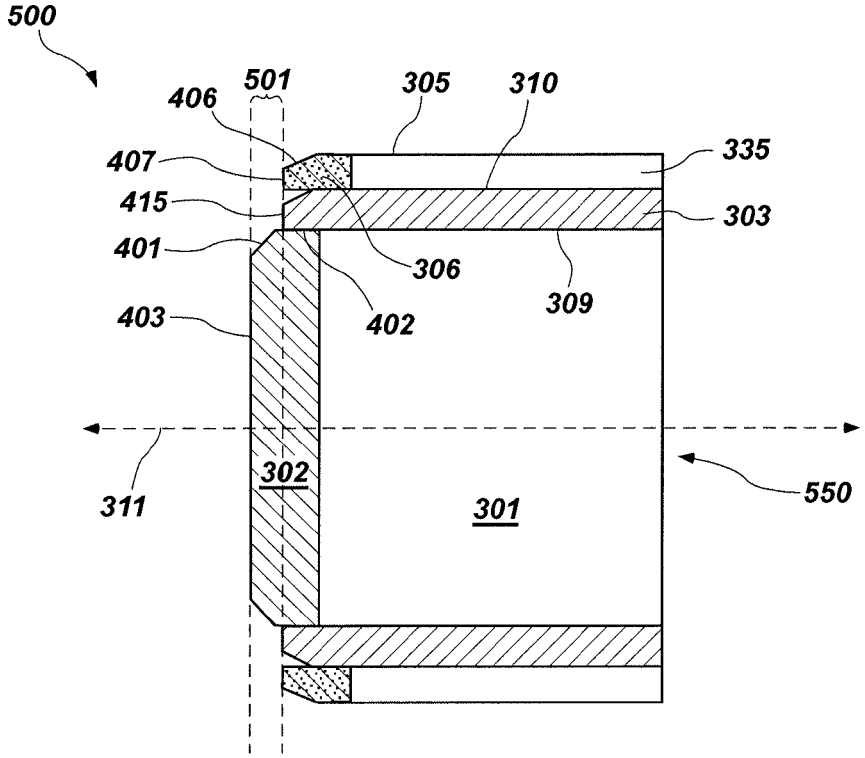
FIGS. 5A-5D include cross-sectional illustrations of cutter elements in accordance with embodiments.

FIG. 5A includes a cross-sectional illustration of a cutting element in accordance with an embodiment. The cutting element 500 includes those components previously described herein, including a cutting body 550 that employs a substrate 301 and a superabrasive layer 302 directly contacting and bonded to an upper surface of the substrate 301. The cutting element 500 further includes a sleeve 305 disposed around an outer peripheral surface of the cutting body 550 and an interface layer 303 disposed between the cutting body 550 and the sleeve 305. Notably, the cutting body 550 is formed such that it axially protrudes beyond the top surfaces of the sleeve 305 and interface layer 303. In particular, the top surface 403 of the superabrasive layer 302 is disposed at an axial position along the longitudinal axis 311 that is different than the axial position along the longitudinal axis 311 of the top surface 415 of the interface layer 303 and top surface 407 of the superabrasive layer 306 of the sleeve 305. Accordingly, the difference in the axial position between the top surface 403 of the superabrasive layer 302 and top surfaces 415 and 407 of the interface layer 303 and 305, respectively, can be defined as an axial protrusion distance 501. The axial protrusion distance 501 can be controlled depending upon the intended application of the cutting element 500.

Figure 5B:
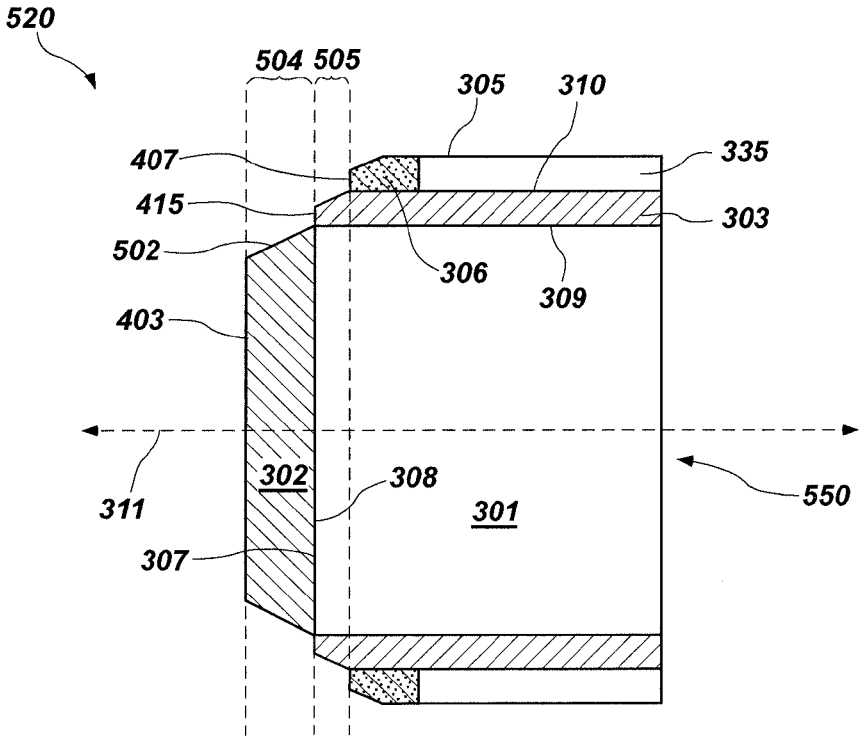

FIG. 5B includes a cross-sectional illustration of a cutting element in accordance with an embodiment. The cutting element 520 includes those components described herein, including a cutting body 550 employing a substrate 301 and a superabrasive layer 302 overlying and bonded to an upper surface of the substrate 301. Moreover, the cutting element 520 includes a sleeve 305 disposed around an outer peripheral surface of the cutting body 550 and an interface layer 303 disposed between an inner surface 310 of the sleeve 305 and the peripheral side surface 309 of the cutting body 550. Notably, the superabrasive layer 302 is formed such that it has an upper surface 403 extending transversely to the longitudinal axis 311 of the cutting body 550 and a chamfered surface 502 extending at an angle to the top surface 403 and terminating at the upper surface 307 of the substrate 301. As such, unlike previously illustrated embodiments, the chamfered surface 502 of the superabrasive layer 302 extends entirely from the top surface 403 to a rear surface 308 of the superabrasive layer 302. That is, there may not necessarily be a side surface between the chamfered surface 502 and the rear surface 308 of the superabrasive layer 302.

Moreover, the cutting element 520 is formed such that the top surface 403 of the superabrasive layer 302 is at a different axial position along the longitudinal axis 311 than the top surface 415 of the interface layer 303. As such, the difference in axial position between the top surface 403 and top surface 415 can be described as an axial protrusion distance 504. Notably, in particular instances, the arrangement between the superabrasive layer 302 and the interface layer 303 is such that the axial protrusion distance 504 is the full width of the superabrasive layer 302.

As further illustrated in FIG. 5B, the cutting element 520 is formed such that the upper surface 415 of the interface layer 303 is disposed at a different axial position along the longitudinal axis 311 of the cutting body 550 than the upper surface 407 of the sleeve 305. In particular, the upper surface 415 of the interface layer 303 protrudes at an axial distance beyond that of the upper surface 407 of the superabrasive layer 306 as defined by an axial protrusion distance 505. Notably, the axial protrusion distance 505 can be controlled depending upon the intended application of the cutting element 520.

Figure 5C:
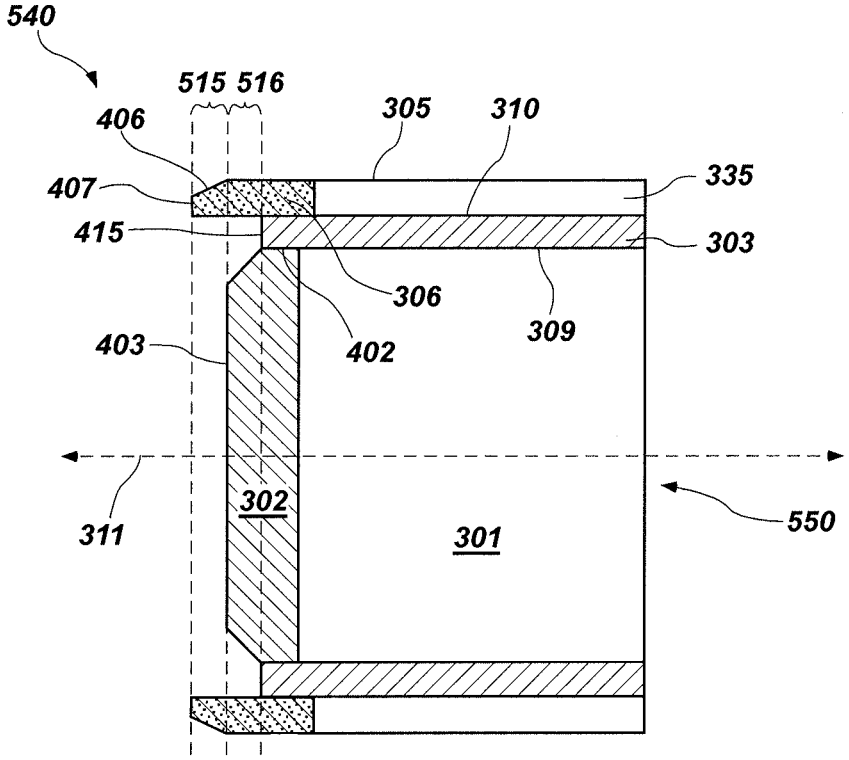

FIG. 5C includes a cross-sectional illustration of a cutting element in accordance with an embodiment. Generally, the cutting element 540 illustrates a cutting body 550 employing a substrate 301 and a superabrasive layer 302 bonded to an upper surface of the substrate 301. The cutting element 540 further includes a sleeve 305 disposed around the cutting body 550, and an interface layer 303 disposed between an inner surface of the sleeve 305 and the peripheral side surface 309 of the cutting body 550. As illustrated, the cutting body 550 is recessed within the central opening of the sleeve 305 such that the top surface 403 of the superabrasive layer 302 occupies a different axial position along the longitudinal axis 311 than an upper surface 407 of the superabrasive layer 306 of the sleeve 305. In particular, the difference in axial position between the upper surface 407 and the upper surface 403 can be described as an axial recess distance 515. In such an arrangement, during operation, the superabrasive layer 306 of the sleeve 305 protrudes at a primary cutting position to initiate a cutting process and the superabrasive layer 302 of the cutting body 550 provides redundant cutting support for the superabrasive layer 306. Notably, the axial recess distance 515 can be controlled depending upon the intended application of the cutting element 540.

As further illustrated, the cutting element 540 can be formed such that the upper surface 415 of the interface layer 303 is recessed from the upper surface 403 and the superabrasive layer 302 and the upper surface 407 of the superabrasive layer 306. In particular, the upper surface 415 of the interface layer 303 can be formed such that it is positioned at a different axial position than the upper surface 403 of the superabrasive layer 302, and particularly recessed behind the upper surface 403 and thus defining a recessed axial distance 516. Notably, the recessed axial distance 516 may be varied depending upon the intended application of the cutting element 540. Moreover, in other embodiments, the interface layer 303 may be formed such that it protrudes axially beyond the upper surface 403 of the superabrasive layer 302 and thus has an upper surface 415 closer to the upper surface 407 of the superabrasive layer 306 of the sleeve 305 than the upper surface 403 of the superabrasive layer 302 of the cutting body 550.

Figure 5D:
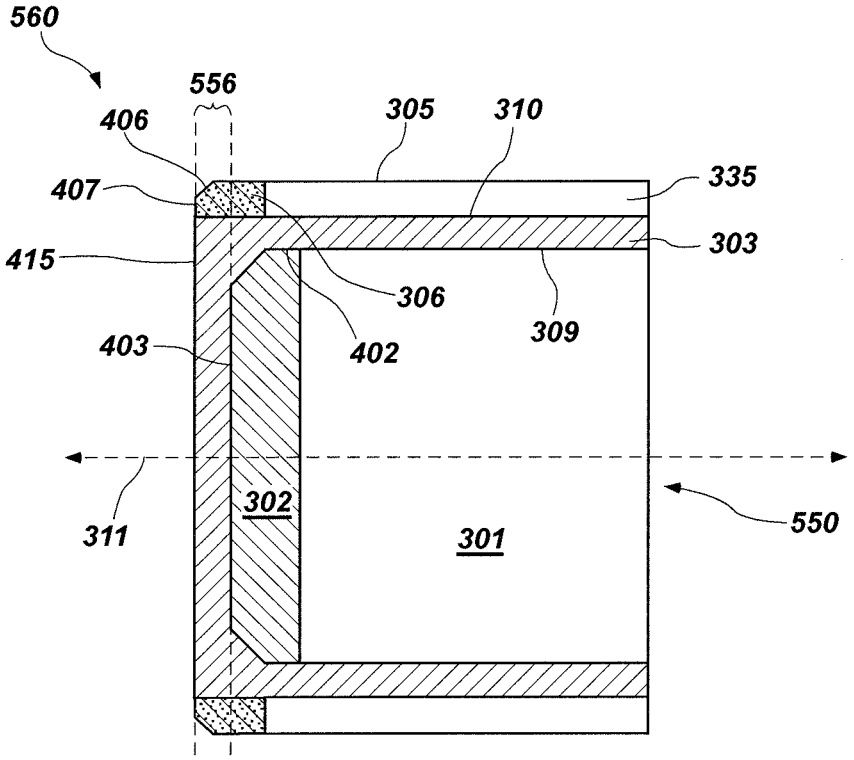

FIG. 5D includes a cross-sectional illustration of a cutting element in accordance with an embodiment. The cutting element 560 illustrates a cutting body 550 employing a substrate 301 and a superabrasive layer 302 bonded to an upper surface of the substrate 301. The cutting element 560 further includes a sleeve 305 extending around the cutting body 550, and an interface layer 303 disposed between an inner surface of the sleeve 305 and a peripheral side surface 309 of the cutting body 550 and extending through the periphery (e.g., circumference) of the peripheral side surface 309 of the cutting body 550. As illustrated, the cutting body 550 is recessed within the central opening of the sleeve 305 such that the top surface 403 of the superabrasive layer 302 occupies a different axial position along the longitudinal axis 311 than an upper surface 407 of the superabrasive layer 306 of the sleeve 305. Like other embodiments, the difference in axial position between the upper surface 407 and the upper surface 403 can be described as an axial recess distance 556. In such arrangements, during operation, the superabrasive layer 306 of the sleeve protrudes at a primary cutting position to initiate a cutting process and the superabrasive layer 302 of the cutting body 550 provides redundant cutting support for the superabrasive layer 306. Notably, the axial recess distance 556 can be controlled depending upon the intended application of the cutting element 560.

Additionally, the cutting element 560 includes an interface layer 303 having an upper surface 415 that occupies a different axial position along the longitudinal axis 311 as compared to the upper surface 403 of the superabrasive layer 302. As such, the upper surface 403 of the superabrasive layer 302 is recessed with reference to the upper surface 415 of the interface layer 303. Accordingly, in some designs the interface layer 303 can overlie a portion, and in some instances the entirety, of the upper surface 403 of the superabrasive layer 302. Moreover, according to the illustrated embodiment, the upper surface 415 of the interface layer 303 is oriented such that it is coterminous and coplanar with the upper surface 407 of the sleeve 305.

Figure 6:
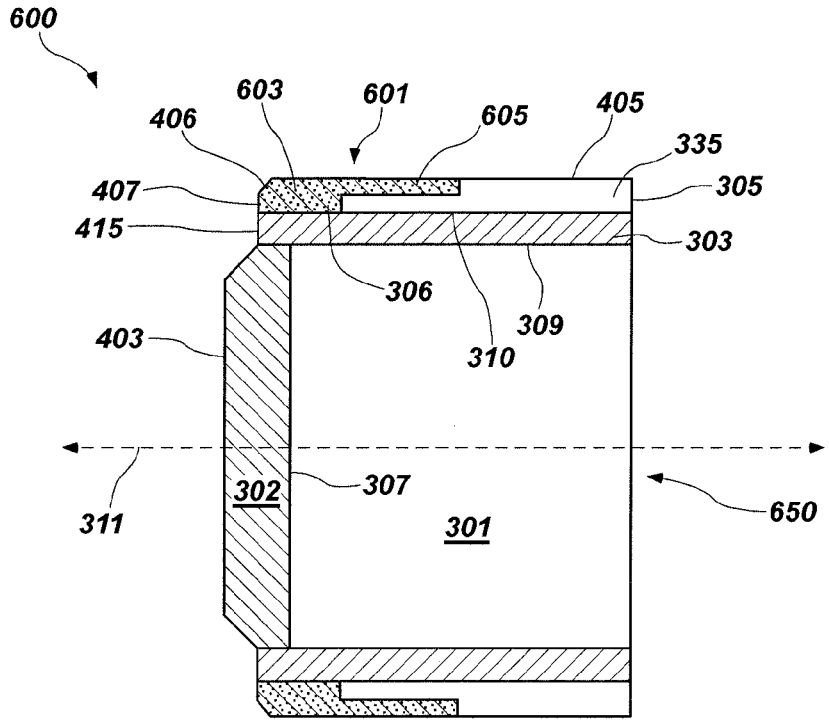
FIG. 6 includes a cross-sectional illustration of a cutter element in accordance with an embodiment.

FIG. 6 includes a cross-sectional illustration of a cutting element in accordance with an embodiment. The cutting element 600 can include a cutting body 650 employing a substrate 301 and a superabrasive layer 302 directly contacting and bonded to an upper surface of the substrate 301. Moreover, the cutting element 600 can include a sleeve 305 surrounding the cutting body 650, and an interface layer 303 disposed between an inner surface of the sleeve 305 and a peripheral side surface of the cutting body 650. The sleeve 305 has a different configuration of a superabrasive layer 601 as attached to the sleeve body portion 335 than other embodiments described herein. That is, the superabrasive layer 601 includes a superabrasive layer portion 603 that is adjacent to the superabrasive layer 302 of the cutting body 650 and defined by a top surface 407 extending transversely to the longitudinal axis 311, a side surface 405 extending parallel to the longitudinal axis 311, and a chamfered surface 406 extending between the top surface 407 and the side surface 405 at an angle to the longitudinal axis 311.

Notably, the superabrasive layer 601 includes a superabrasive layer portion 605 that extends axially and radially along the longitudinal axis 311 at an extended distance along the side surface 405 of the sleeve 305. According to certain embodiments, the superabrasive layer 306 can be formed with a superabrasive layer portion 605 that extends for at least about 25%, such at least about 30%, at least about 40% and particularly between about 25% and about 75% of the total axial length of the side surface 405 of the sleeve 305. The superabrasive layer portion 605 extends the effective length of the superabrasive layer 601 along the side surface 405 of the sleeve 305, which may be suitable for operations wherein a greater amount of the sleeve 305 is expected to be engaged in cutting.

Figure 7:
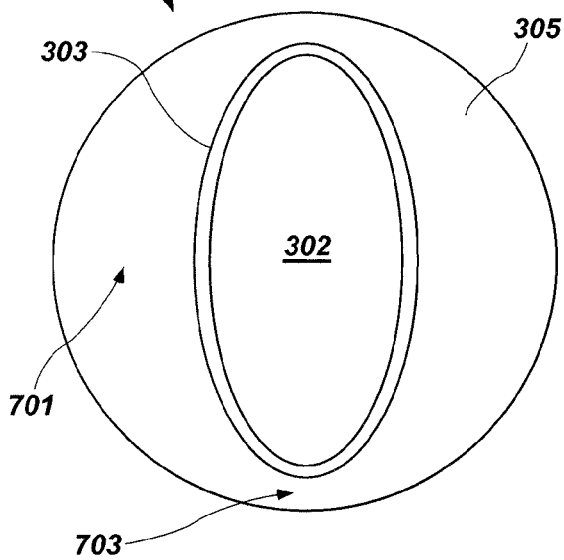
FIG. 7 includes a top view illustration of a cutter element in accordance with an embodiment.

FIG. 7 includes a top view of a cutting element in accordance with an embodiment. Notably, the cutting element 700 is formed such that a cutting body, and particularly the superabrasive layer 302 overlying the cutting body has an elliptical cross-sectional contour as viewed perpendicular to a longitudinal axis of the cutting body. Moreover, the cutting elements have been formed such that the interface layer 303, disposed between the superabrasive layer 302, and the sleeve 305 has a generally elliptical cross-sectional contour as viewed perpendicular to the longitudinal axis of the cutting body. As such, the sleeve 305 is formed such that it may properly engage and contain the cutting body including the superabrasive layer 302 and the interface layer 303. In particular, the sleeve 305 is formed such that it has regions 701 of greater radial thickness between an outer surface and an inner surface, and regions 703 of less radial thickness between the outer surface and the inner surface when the cutting element 700 is viewed in perpendicular to the longitudinal axis of the cutting body.

Figure 8A:
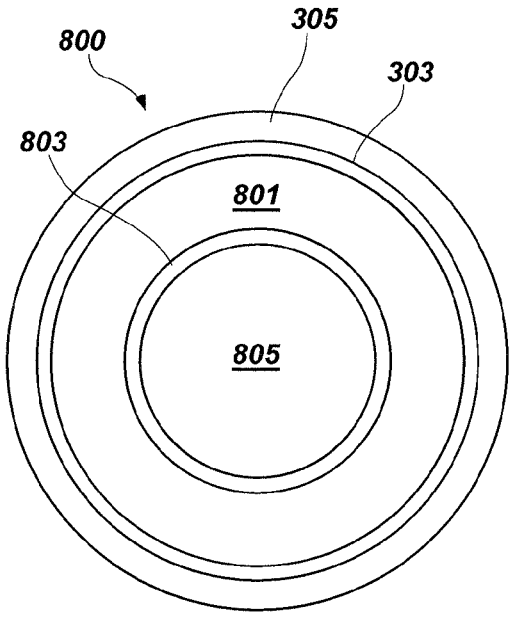
FIGS. 8A-8C include cross-sectional illustrations and a perspective view of cutter elements in accordance with embodiments.

FIG. 8A includes a top view illustration of a cutting element in accordance with an embodiment. The cutting element 800 includes multiple superabrasive layers including a first superabrasive layer 801 and a second superabrasive layer 805 arranged concentrically with respect to each other. In particular, the first superabrasive layer 801 has a generally annular shape having a central opening, wherein the second superabrasive layer 805 is disposed therein. Notably, an arresting layer 803 can be disposed between the first superabrasive layer 801 and the second superabrasive layer 805 to absorb mechanical strain and mitigate the transfer of mechanical strain between the two superabrasive layers 801, 805.

In accordance with an embodiment, the arresting layer 803 can be formed of a material having a Mohs hardness that is less than a Mohs hardness of the first superabrasive layer 801 or the second superabrasive layer 805. For example, the arresting layer 803 can be made of a material such as a carbide, a nitride, an oxide, a boride, a carbon-based material, and a combination thereof. In particular instances, the arresting layer 803 can be formed such that it is made of a carbide. Still, in other instances, the arresting layer 803 can be formed of a metal or a metal alloy and may particularly include transition metal elements. Some suitable transition metal elements can include nickel, tin, silver, palladium, copper, zinc, iron, manganese, chromium, tantalum, vanadium, titanium, cobalt, and a combination thereof. Notably, in particular embodiments, the arresting layer 803 can be made of a metal braze composition or metal binder composition. For example, one particular type of arresting layer can be made of steel.

As further illustrated, the cutting element 800 can include an interface layer 303 disposed around and substantially surrounding the first superabrasive layer 801 such that it substantially surrounds the periphery (e.g., circumference) of the first superabrasive layer 801. Moreover, the cutting element 800 can include a sleeve 305 disposed around the periphery of the interface layer 303.

Figure 8B:
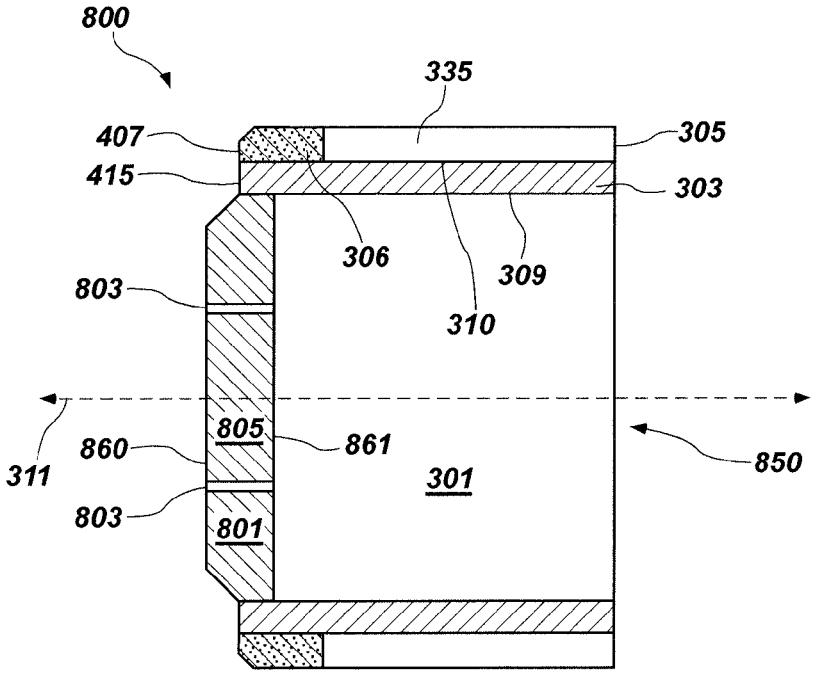

FIG. 8B includes a cross-sectional illustration of the cutting element illustrated in FIG. 8A. As more fully demonstrated by the illustration of FIG. 8B, the arresting layer 803 can be oriented such that it extends axially, parallel to the longitudinal axis 311 between the upper surface 860 and the rear surface 861 of the first and second superabrasive layers 801 and 805. Notably, the arresting layer 803 can extend for the full thickness of the first and second superabrasive layers 801 and 805.

Figure 8C:
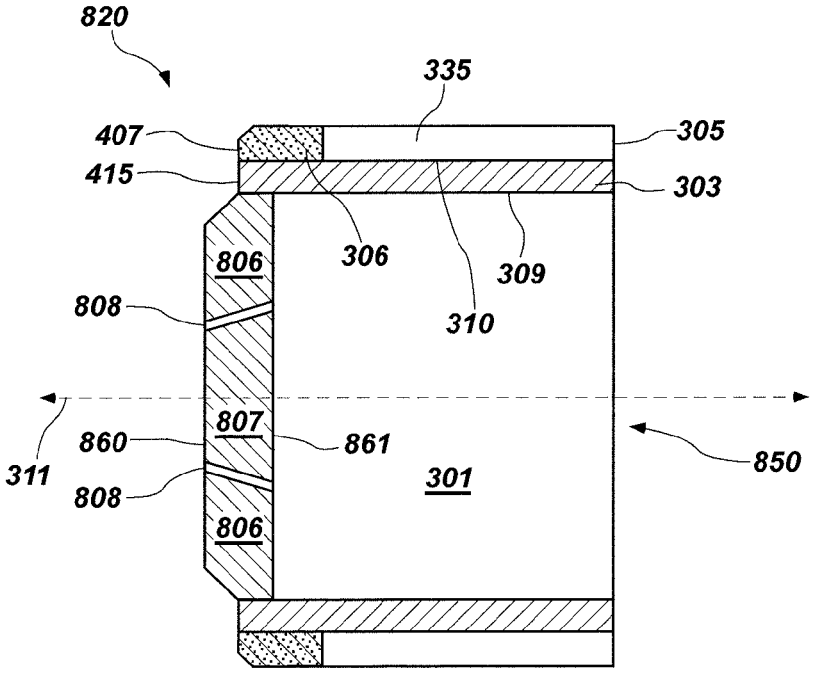

FIG. 8C includes a cross-sectional illustration of a cutting element in accordance with an embodiment. The cutting element 820 includes those elements previously described herein including a cutting body 850 having a substrate 301 and a first superabrasive layer 806 and a second superabrasive layer 807 overlying in directly bonded to an upper surface of the substrate 301. The cutting element 820 can be formed such that an arresting layer 808 is disposed between the first superabrasive layer 806 and the second superabrasive layer 807. In particular, the arresting layer 808 is oriented at an angle relative to the longitudinal axis 311 of the cutting body 850. Such a design results in a trapezoidal contour (as viewed in cross-section) of the second superabrasive layer 807, which gives the second superabrasive layer 807 a natural chamfered edge as defined by the orientation of the arresting layer 808.

FIGS. 9A-9D include illustrations of cutting elements demonstrating different means of affixing the cutting body and the sleeve to each other. While previous embodiments have noted that the cutting body and the sleeve (and, additionally, the interface layer, if present) can be bonded to each other, exemplary cutting elements herein can employ certain mechanical features to facilitate mechanical connection between the cutting body and the sleeve. In addition to facilitating mechanical connection, certain features may also aid proper orientation between the sleeve and cutting body to maintain proper cutting action during use. For example, the cutting elements herein can utilize mechanical connections between the cutting body and the sleeve including, for example, interlocking-fit connections having complementary surface features on respective components (e.g., protrusions and recesses), interference-fit connections using movable portions (e.g., tabs, spring-loaded components, and biased components), and other notable connection mechanisms such as grooved connections, pin connections, threaded connections, taper-lock connections, and complex movement connections such as rotational and/or translational movement connections, and the like.

Figure 9A:
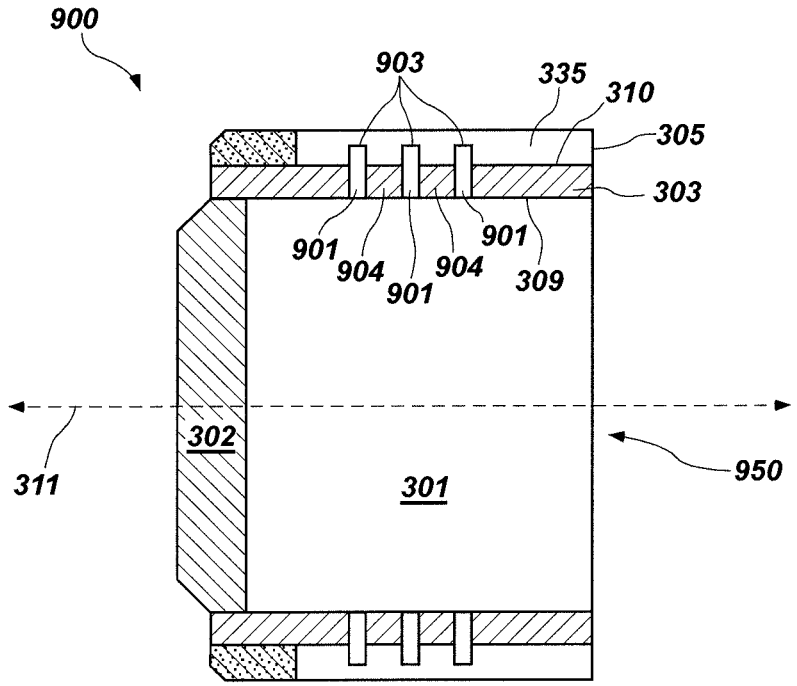
FIGS. 9A-9D include cross-sectional illustrations of cutter elements in accordance with embodiments.

FIG. 9A includes a cross-sectional illustration of a cutting element in accordance with an embodiment. The cutting element 900 includes certain features described herein including a cutting body 950 having a substrate 301 and a superabrasive layer 302 overlying and bonded to an upper surface of the substrate 301. Additionally, the cutting element 900 includes a sleeve 305 surrounding a peripheral side surface 309 of the substrate 301, and an interface layer 303 disposed between the sleeve 305 and the substrate 301. Notably, the substrate 301 includes non-linear surface features, otherwise known as protrusions 901, that extend radially outward from the peripheral side surface 309 for affixing the cutting body 950 to the sleeve 305. The protrusions 901 are laterally spaced apart along the longitudinal axis 311 of the cutting body 950 and can extend circumferentially around the entire outer surface of the peripheral side surface 309. For certain cutting elements, the protrusions 901 can be arranged in a patterned array extending along the entire peripheral side surface 309 of the cutting body 950.

The sleeve 305 comprises grooves 903 along its inner surface 310 for complementary engagement of the protrusions 901 therein to affix the sleeve 305 and cutting body 950 to each other. In certain designs, the grooves 903 can be formed such that each of the protrusions 901 are received within a complementary groove 903 to affix the sleeve 305 and the cutting body 950 to each other.

As illustrated, the interface layer 303 can be disposed within recesses 904 between the protrusions 901. In other embodiments, the interface layer 303 may not necessarily be disposed within the recesses 904.

Figure 9B:
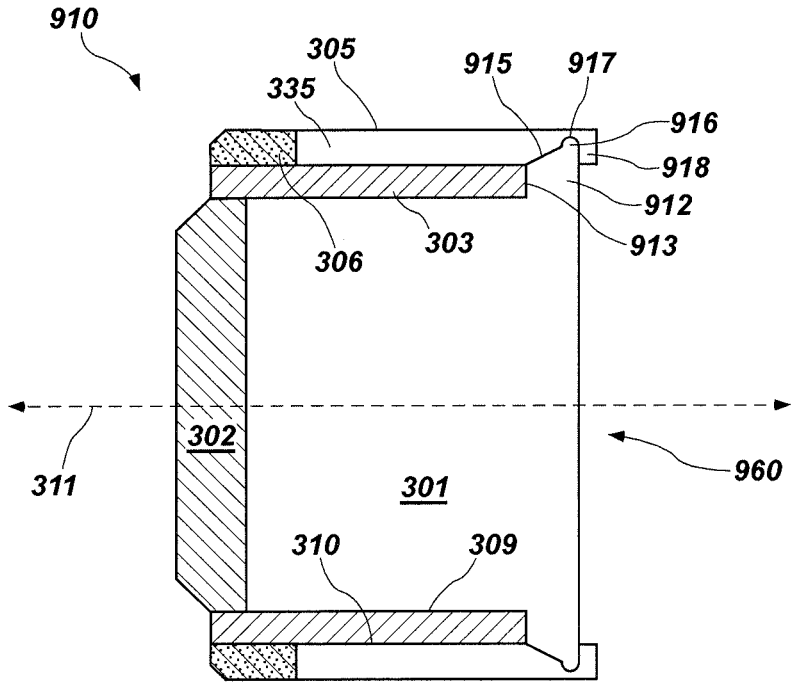

FIG. 9B includes a cross-sectional illustration of a cutting element in accordance with an embodiment. The cutting element 910 includes certain features described herein including a cutting body 960 having a substrate 301 and a superabrasive layer 302 overlying and bonded to an upper surface of the substrate 301. Additionally, the cutting element 910 includes a sleeve 305 surrounding a peripheral side surface 309 of the substrate 301, and an interface layer 303 disposed between the sleeve 305 and the substrate 301. Notably, the substrate 301 includes non-linear surface features including a projection 912 that extends radially outward from the peripheral side surface 309 for affixing the cutting body 960 to the sleeve 305. In certain designs, the projection 912 can be oriented adjacent to, or more particularly, abutting the rear surface 308 of the substrate 301. Moreover, the projection 912 can extend through the entire periphery (e.g., circumference) of the peripheral side surface 309 of the cutting body 960.

The projection 912 can include various non-linear surface features for affixing the sleeve 305 and the cutting body 960 to each other. For example, the projection 912 can have a front surface 913 extending radially outward from the peripheral side surface 309 and configured to provide a surface for containing and abutting the interface layer 303. The projection 912 can further include a chamfered or sloped surface 915 extending radially outward at an angle from the front surface 913 and configured to facilitate sliding of the interface layer 303 of the sleeve 305 over the cutting body 960. In particular, the sloped surface 915 facilitates translation of the sleeve arm portion 918 over and past the projection 912 when the sleeve 305 is configured to be engaged on the cutting body 960.

Moreover, the projection 912 can include a catch portion 916 extending from the projection 912 and configured to facilitate a locking connection between the sleeve 305 and the cutting body 960 once assembled. The catch portion 916, as illustrated, can have a rounded or arcuate surface for facilitating sliding of the sleeve arm portion 918 past the catch portion 916 and locking of the components together. As illustrated, the sleeve 305 can have a groove 917 extending radially inward into the sleeve body portion 335 for complementary engagement of the projection 912 and the catch portion 916. While embodiment of FIG. 9B provides one example of a snap-fit connection between the sleeve 305 and the cutting body 960, other mechanisms and configurations of surfaces and shapes may be used to affix the sleeve 305 and cutting body 960 to each other.

Figure 9C:
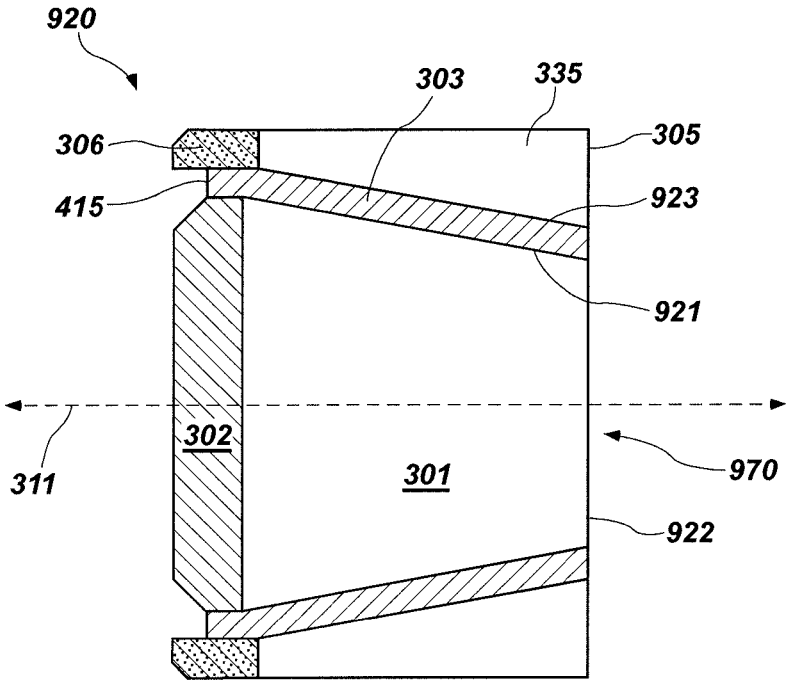

FIG. 9C includes a cross-sectional illustration of a cutting element in accordance with an embodiment. The cutting element 920 includes certain features described herein including a cutting body 970 having a substrate 301 and a superabrasive layer 302 overlying and bonded to an upper surface of the substrate 301. Additionally, the cutting element 920 includes a sleeve 305 surrounding a peripheral side surface 921 of the substrate 301, and an interface layer 303 disposed between the sleeve 305 and the substrate 301. Notably, the cutting body 970, which includes the substrate 301, is formed such that it has a tapered peripheral side surface 921 that extends at an angle to the longitudinal axis 311 of the cutting body 970. The tapered peripheral side surface 921 of the substrate 301 can be formed such that it forms an obtuse angle at the joint between a rear surface 922 of the substrate 301 and the tapered peripheral side surface 921.

The cutting element 920 further comprises a sleeve 305 having a sleeve body portion 335, wherein an inner surface 923 of the sleeve body portion 335 can be a tapered inner surface 923 extending at an angle relative to the longitudinal axis 311 of the cutting body 970. In particular, the tapered inner surface 923 of the sleeve 305 is formed such that it is complementary to the tapered peripheral side surface 921 of the substrate 301 such that the cutting body 970 can be placed within the sleeve 305 to form a taper-lock connection between the components. Notably, such a design facilitates locking of the two components together, particularly during use wherein axial forces are present on the superabrasive layers 302, 306 forcing the two components to maintain their interlocked relationship.

Notably, certain embodiments utilizing the connection type illustrated in FIG. 9C may use different arrangements of the interface layer 303. That is, in some cutting elements, the interface layer 303 may extend for a portion of the length of the cutting body 970 along the longitudinal axis 311 for a distance less than the full length of the cutting body 970. For example, it may extend from the upper surface 415 toward the rear surface 922 of the substrate 301 for not greater than about 90%, not greater than about 75%, not greater than about 50%, not greater than about 25%, and particularly within a range between about 10% and about 90%, or even between about 25% and about 75% of the total length of the cutting body 970. In still another alternative embodiment, the interface layer 303 may not necessarily be present.

Figure 9D:
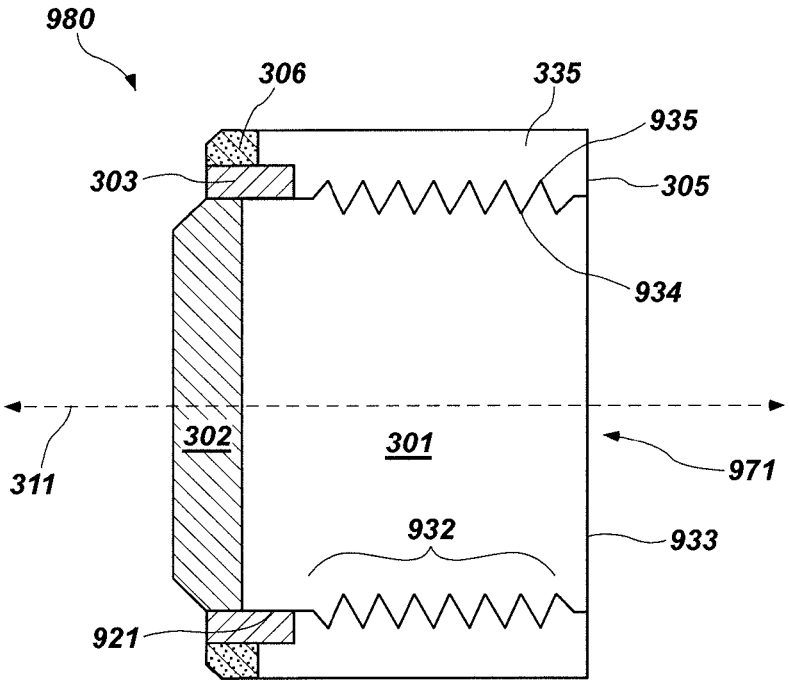

FIG. 9D includes a cross-sectional illustration of a cutting element in accordance with an embodiment. The cutting element 980 includes certain features described herein including a cutting body 971 having a substrate 301 and a superabrasive layer 302 overlying and bonded to an upper surface of the substrate 301. Additionally, the cutting element 980 includes a sleeve 305 surrounding a peripheral side surface 921 of the substrate 301, and an interface layer 303 partially disposed between the sleeve 305 and the substrate 301, and particularly between the superabrasive layer 306 of the sleeve 305 and the superabrasive layer 302 of the cutting body 971.

Notably, the substrate 301 is connected to the sleeve 305 through a threaded connection. In particular, the substrate 301 comprises a threaded inner surface 934 that extends around the entire periphery of the substrate 301. The threaded inner surface 934 is configured to be engaged with a complementary threaded inner surface 935 of the sleeve 305. Accordingly, the cutting body 971 can be engaged with the sleeve 305 by placing the cutting body 971 with the rear surface 933 into the sleeve 305 and screwing the components together.

The threaded region 932 can extend for a portion of the distance along the peripheral side surface 921 and threaded inner surface 935 of the substrate 301 and the sleeve 305, respectively. For example, the threaded region 932 can extend for not greater than about 90%, not greater than about 75%, not greater than about 50%, not greater than about 25%, and particularly within a range between about 10% and about 90%, or even between about 25% and about 75% of the total length of the cutting body 971 extending along the longitudinal axis 311.

The formation of the cutting elements described herein can be completed using one or more particular methods. For example, the cutting body can be formed using a high-pressure/high-temperature (HP/HT) process, wherein the substrate material is loaded into a HP/HT cell with the appropriate orientation and amount of diamond crystal material, typically of a size of 100 microns or less. Furthermore, a metal catalyst powder can be added to the HP/HT cell, which can be provided in the substrate or intermixed with the diamond crystal material. The loaded HP/HT cell is then placed in a process chamber, and subject to high temperatures (typically 1450° C. to 1600° C.) and high pressures (typically 50-70 kilobar), wherein the diamond crystals, stimulated by the catalytic effect of the metal catalyst powder, bond to each other and to the substrate material to form a PDC product. It will be appreciated that the PDC product can be further processed to form a thermally stable polycrystalline diamond material (commonly referred to as "TSP") by leaching out the metal in the diamond layer. Alternatively, silicon, which possesses a coefficient of thermal expansion similar to that of diamond, may be used to bond diamond particles to produce a Si-bonded TSP. TSPs are capable of enduring higher temperatures (on the order of 1200° C.) in comparison to normal PDCs.

Depending upon the method of formation chosen, the sleeve comprising the superabrasive layer (e.g., polycrystalline diamond) can be formed at the same time using the same techniques as the process used to form the cutting body. That is, a high-pressure/high-temperature (HP/HT) process. In certain instances, the formation of the cutting body and the sleeve can be completed simultaneously, such that the they are formed in the same chamber at the same time. Such a process may require a special HP/HT cell capable of accommodating both components and effectively forming both of the components.

In fact, in certain embodiments, the cutting element can be formed as a single article, which is a preform cutting element comprising a substrate having single layer of superabrasive material overlying and bonded to the upper surface of the substrate. After formation of the preform cutting element, a machining process may be employed to form a separate sleeve and cutting body from the preform cutting element. For example, an electrical discharge machining (EDM) process may be utilized to cut a sleeve from the preform cutting element and thus form the separate cutting body and sleeve portions.

Use of such a process further allows for control of the interface layer and combinations of different types of cutting elements. For example, larger sized (e.g., diameter) cutting elements can be formed and machined to obtain the sleeve portion, which can be combined with other cutting elements, such as those having a smaller size (e.g., diameter) that fit within the sleeve. Using such a process facilitates the matching and coordination of superabrasive layer characteristics for particular drill bits to be used in certain subterranean formations. That is, the sleeve can be formed from a cutting element having certain characteristics, which can be combined with a cutting body having certain and different characteristics to form a hybrid cutting element having a combination of mechanical characteristics (e.g., abrasiveness, wear resistance, toughness, etc.).

The process of forming the cutting element may further include a process of joining the sleeve and cutting body, which may also include the formation of an interface layer disposed between the sleeve and the cutting body as described herein. Depending upon the material of the interface layer, various formation methods can be used. For example, the sleeve and the cutting body can be pressed together, brazed or bonded together, cast together, locked together based upon mechanical connections described herein, or a combination thereof.

In those embodiments employing an interface layer, the material forming the interface layer can be formed prior to, or during, the joining of the sleeve and the cutting body. The interface layer can be formed on the peripheral side surface of the cutting body, the inner surface of the sleeve, or both. According to one particular forming method, the interface layer can include formation of a film, or the like, on the desired surface, followed by a drying or heating process to solidify and/or bond the interface layer material to the select surface of the cutting element. After suitable formation of the interface layer, the components can be fitted and affixed to each other to form a cutting element.

As noted above, one particular process of affixing the sleeve and the cutting body to each other can include a pressing operation, wherein pressure is applied to the side surfaces of the sleeve to compress the sleeve and press-fit the sleeve to the cutting body. Such a process may further include an application of heat to the component during pressing to assure proper bonding, particularly if the interface layer employs a metal or other low temperature interface material component.

Another process of joining the sleeve and cutting body can be a brazing or bonding process. In such processes, the interface layer can be formed of a metal or metal alloy material suitable for facilitating a brazed or bonded connection between the sleeve and the cutting body. Certain brazing compounds may employ active brazing alloys, such as those incorporating tantalum. Some of the brazing processes can be completed in an inert environment to reduce the impact of the oxidation and graphitization (in the instance diamond materials are used), and aid proper formation of the braze. The inert environment may be provided by the use of an inert gas, such as nitrogen, argon, and the like. It will be appreciated that any of the above-noted methods of joining the sleeve and the cutting body can be combined with mechanical connection means described herein.

As will be appreciated, machining processes can be employed for finishing the surfaces of the cutting body, the sleeve, and even the interface layer. Finishing processes can be conducted after the formation of the sleeve and the cutting body, or alternatively, after joining the cutting body and the sleeve, or any other time. Finishing processes can be undertaken to prepare the surfaces of the cutting element, and include providing chamfers, removing burrs and irregularities, and overall shaping of the cutting element. Moreover, the surfaces of the cutting body and the sleeve may be polished. Typical machining processes can include electro-discharge machining or (EDM) processes.

The cutting elements herein demonstrate a departure from the state-of-the-art. While cutters designs have been disclosed in the past to mitigate problems associated with mechanical strain, temperature-induced strain, and wear, typically the changes in cutter design have been directed to changing the configuration between the cutter table and/or substrate. By contrast, the embodiments herein are directed to cutting elements incorporating multiple components employing a cutting body, a sleeve, an interface layer, and even an arresting layer for prohibiting crack propagation and other defects. Other combinations of features include certain designs of the cutting body, sleeve, and interface layer, particularly the utilization of multiple chamfers, and even configurations wherein an unused chamfered edge of one component (e.g., the cutting body) is exposed to a rock formation after wear of the leading chamfered edge of another component (e.g., the sleeve). Embodiments herein further include a combination of features directed to the orientation between the components, different structures of the components (e.g., layered structures), various materials for use in the components, particular surface features of the components, and certain means of affixing the components to each other including various mechanical connections. The combination of features have been developed to provide a selectability in the characteristics of the cutting elements by having the capability to select various characteristics of the components (i.e., sleeve, cutting body, and interface layer) and use them together to form a cutting element capable of achieving improved performance. Additionally, the provision of multiple components, which are arranged in a particular orientation with respect to each other, can further improve the wear characteristics and thus, usable life of the cutting elements by reducing the mechanical-induced strains and temperature-induced strains on the article.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

What is claimed is:

1. A cutting element for use in a drill bit for drilling subterranean formations, comprising:

a cutting body, comprising:

a substrate comprising a rear surface, an upper surface, and a peripheral side surface extending from the rear surface to the upper surface; and a first superabrasive layer overlying the upper surface of the substrate, the first superabrasive layer having a rear surface adjacent the upper surface of the substrate, an upper surface, and a peripheral side surface extending from the rear surface to the upper surface;

wherein the cutting body comprises at least one peripheral side surface comprising the peripheral side surface of the substrate and the peripheral side surface of the first superabrasive layer;

and a sleeve comprising:

a sleeve body comprising a rear surface, an upper surface, a peripheral side surface extending from the rear surface to the upper surface, and an interior side surface extending from the rear surface to the upper surface; and a second superabrasive layer bonded to the upper surface of the sleeve body, the second superabrasive layer having a rear surface adjacent the upper surface of the sleeve body, an upper surface, a peripheral side surface extending from the rear surface to the upper surface, and an interior side surface extending from the rear surface to the upper surface;

wherein the sleeve comprises at least one interior side surface comprising the interior side surface of the sleeve body and the interior side surface of the second superabrasive layer, the at least one interior side surface of the sleeve surrounding the cutting body such that at least one of a gap and an interface material is disposed directly radially between the first superabrasive layer and the second superabrasive layer;

wherein the upper surface of the first superabrasive layer is coplanar with or recessed below the upper surface of the second superabrasive layer.

2. The cutting element of claim 1, wherein the substrate comprises a metal or a metal alloy material.

3. The cutting element of claim 1, wherein the substrate consists essentially of tungsten carbide.

4. The cutting element of claim 1, wherein the second superabrasive layer comprises a material selected from the group of materials consisting of diamond, boron nitride, fullerenes, and a combination thereof.

5. The cutting element of claim 1, wherein the cutting body further comprises a third superabrasive layer separate from the first superabrasive layer.

6. The cutting element of claim 5, wherein the first and second superabrasive layers are concentrically oriented to each other.

7. The cutting element of claim 1, wherein the cutting body further comprises a third superabrasive layer overlying the upper surface of the substrate and an arresting layer between the first superabrasive layer and the third superabrasive layer.

8. The cutting element of claim 7, wherein the arresting layer comprises a material having a Mohs hardness less than Mohs hardnesses of the first and third superabrasive layers.

9. The cutting element of claim 1, wherein the interface material comprises a metal or a metal alloy material.

10. The cutting element of claim 1, wherein the interface material comprises a material selected from the group of materials consisting of carbides, nitrides, borides, and oxides.

11. The cutting element of claim 1, wherein the sleeve body comprises a material different than a material of the substrate.

12. The cutting element of claim 1, wherein the second superabrasive layer comprises a chamfered surface extending at an angle to the upper surface of the second superabrasive layer.

13. The cutting element of claim 1, wherein the cutting element is mounted to a body of a rotary drill bit.

14. A cutting element for use in a drill bit for drilling subterranean formations, comprising:

a cutting body, comprising:

a substrate comprising a rear surface, an upper surface, and a peripheral side surface extending from the rear surface to the upper surface;

a first superabrasive layer comprising a rear surface, a top surface, and a peripheral side surface extending from the rear surface to the top surface, the rear surface overlying the upper surface of the substrate;

and a sleeve surrounding the peripheral side surface of the substrate and the first superabrasive layer, the sleeve comprising:

a sleeve body comprising a rear surface and an upper surface;

a second superabrasive layer comprising a rear surface and an upper surface, the rear surface of the second superabrasive layer bonded to the upper surface of the sleeve body; and an interior side surface extending from the rear surface of the sleeve body to the top surface of the second superabrasive layer;

wherein the interior side surface of the sleeve at least partially surrounds the cutting body such that at least one of a gap and an interface material is disposed directly radially between the first superabrasive layer and the second superabrasive layer; and wherein the upper surface of the first superabrasive layer is coplanar with or recessed below the upper surface of the second superabrasive layer.

15. The cutting element of claim 14, wherein the interface material comprises a material having a Mohs hardness not greater than a Mohs hardness of the substrate.

16. The cutting element of claim 15, wherein the interface material comprises a material selected from the group of materials consisting of carbides, nitrides, borides, and oxides.

17. The cutting element of claim 16, wherein the interface material comprises a carbide material.

18. The cutting element of claim 15, wherein the interface material comprises abrasive grit contained within a matrix material.

19. The cutting element of claim 14, wherein the cutting element is mounted to a body of a rotary drill bit.

20. A cutting element for use in a drill bit for drilling subterranean formations, comprising:

a cutting body, comprising:

a substrate comprising a rear surface, an upper surface, and a peripheral side surface extending from the rear surface to the upper surface; and a first superabrasive layer comprising a rear surface, a top surface, and a peripheral side surface extending from the rear surface to the top surface, the rear surface overlying the upper surface of the substrate; and a sleeve comprising:

a sleeve body comprising a rear surface, an upper surface, and an interior side surface extending from the rear surface to the upper surface; and a second superabrasive layer comprising a rear surface, a top surface, and an interior side surface extending from the rear surface to the top surface, the rear surface overlying and bonded to the upper surface of the sleeve body;

wherein the interior side surfaces of the sleeve body and the second superabrasive layer are each at least partially surrounding the cutting body such that at least one of a gap and an interface material is disposed directly radially between the first superabrasive layer and the second superabrasive layer;

wherein the upper surface of the first superabrasive layer is coplanar with or recessed below the upper surface of the second superabrasive layer.

21. The cutting element of claim 20, wherein the second superabrasive layer has a chamfered surface angled with respect to the top surface of the second superabrasive layer.

22. The cutting element of claim 20, wherein the cutting element is mounted to a body of a rotary drill bit.

* * * * *